US006766623B1

(12) United States Patent
Kalnay

(10) Patent No.: US 6,766,623 B1
(45) Date of Patent: Jul. 27, 2004

(54) FOLDABLE, EXPANDABLE FRAMEWORK FOR A VARIETY OF STRUCTURAL PURPOSES

(76) Inventor: Peter A. Kalnay, P.O. Box 2798, Cupertino, CA (US) 95015-2798

( * ) Notice: Subject to any disclaimer, the term of this patent is extended or adjusted under 35 U.S.C. 154(b) by 0 days.

(21) Appl. No.: 10/392,148

(22) Filed: Mar. 18, 2003

(51) Int. Cl.[7] ..... E04B 1/32; E04H 15/36

(52) U.S. Cl. ..... 52/641; 52/646; 135/128; 135/147

(58) Field of Search ..... 52/641, 71, 646, 52/637, 645; 135/128, 129, 130, 135, 137, 143, 147, 148, 159, 160; 446/487, 478, 125, 126

(56) References Cited

U.S. PATENT DOCUMENTS 3,590,865 A * 7/1971 Bremshey ..... 135/26
4,256,129 A * 3/1981 Gilsenan ..... 135/98
4,473,986 A * 10/1984 Zeigler ..... 52/645
4,998,552 A * 3/1991 Niksic et al. ..... 135/136
5,421,356 A * 6/1995 Lynch ..... 135/145
5,794,640 A * 8/1998 Jang ..... 135/131
6,021,795 A * 2/2000 Long et al. ..... 135/98
6,354,316 B1 * 3/2002 Chen ..... 135/100
6,516,823 B1 * 2/2003 Glover et al. ..... 135/94

FOREIGN PATENT DOCUMENTS

FR 2842401 * 7/2002

* cited by examiner

*Primary Examiner*—Leslie A. Braun
*Assistant Examiner*—Tan Le
(74) *Attorney, Agent, or Firm*—Donald R. Boys; Central Coast Patent Agency, Inc.

(57) ABSTRACT

A foldable, deployable framework for a structure has a lower hub having a first central axis, sets of tracks, masts, and rafters connected pivotally to the lower hub, to one another, and to an upper hub in a manner that allows the framework to be folded into one, two or three small packages, and to be deployed into a structural frame supporting floors, walls, and roof for an enclosed structure. In different versions folding and deployment is accomplished in a different way. Structures based on the framework can be made for many and varied purposes.

20 Claims, 31 Drawing Sheets

FOLDABLE, EXPANDABLE FRAMEWORK FOR A VARIETY OF STRUCTURAL PURPOSES

FIELD OF THE INVENTION

The present invention is in the area of structures and enclosures, including frameworks, and pertains more particularly to a foldable, expandable framework that is easily portable, and can be used as the skeleton of a broad variety of structures of different sorts.

BACKGROUND OF THE INVENTION

It is broadly recognized that human beings have created a broad variety of structures for such as protection from the elements, storage of tools, travel on bodies of water and the like. Typically such human-built structures have a framework and covering elements over the framework. The framework provides shape and strength, and the covering elements close openings between framing elements to provide protection, for example, to persons or items within the structures, and support, for example, roofs, walls and floors.

Human-made structures as defined above include, for example, conventional frame houses, the framework for which is typically a matrix of interconnected beams and boards, and the covering elements for which may take a variety of forms, such as clapboards, bricks or stones, tile (roofs), plywood panels, and the like. Such structures also include, for example, high-rise buildings, which typically have a framework of steel beams and a covering of wall, roof, ceiling and floor elements. Framed structures in the sense meant here also includes those with the capacity to contain forces from within, for example silos, concrete forms and tanks, as well as to resist forces from the outside, which may include not only the elements which land based shelters afford, but also water in the manner of boat or ship hulls. Other kinds of structures include portable units like tents, the framework for which may be inter-connectable rods and bars, and the coverings for which may be fabric units. Such portable units are designed typically such that the coverings, which may broadly be termed skins, may be removed and the frameworks dismantled or even folded up into a smaller package for transport and storage. Framed structures in the admittedly broad sense intended herein further includes those required to support little more than their own weight and stand against the wind, for example towers, antennae, wings, fins, or airfoils. Also included among framed structures are those with the capacity to rotate or roll, for instance, turntables, carousels, turbines, propellers, and (most fundamentally) wheels. Many types of farm, ranching, fishing, warehousing, containerizing, palletizing, road-building, shipping, airborne and mining equipment and machinery utilize framed structures within the meaning of phrase intended here, to give but several examples. Whilst some framed structures provide protection or containment from all directions, others may be intended to bear loads and/or protect against the elements primarily from above or below, for example canopies, decks, scaffolds, piers, docks, quays, rafts, and broadly speaking, platforms of all kinds.

As the human population becomes more numerous and mobile, and as experience has been gained in mass production techniques, it has been recognized that standardization provides cost benefits and expanded use, and it is clear that inventions that increase standardization, lower cost, and expand use for structures for human purposes are clearly needed. It is also clear that portability is important for structures of many sorts, and an improvement in characteristics of portability for structures is almost always desirable.

SUMMARY OF THE INVENTION

In a preferred embodiment of the present invention a foldable, deployable framework for a structure is provided, comprising a lower hub having a first central axis, a set of three or more equal-length tracks each having a first track end pivotally attached to the lower hub such that each track pivots in a separate track plane parallel to the first axis, a set of three or more masts of equal length the same as or less than the length of the tracks, the number of masts equal to the number of tracks, each mast having a first mast end pivotally attached at a second track end, opposite the first track end, to one of the three tracks such that the masts pivot in planes adjacent to and parallel to the planes of the attached tracks, a set of three or more rafters of equal length greater than the length of either masts or tracks, the number of rafters equal to the number of masts, each rafter having a first rafter end pivotally attached at a second mast end, opposite the first mast end, to one of the three masts, such that the rafters pivot in planes adjacent to and parallel to the pivot planes of the attached masts and tracks, and an upper hub having a second central axis coaxial with the first central axis of the lower hub, with each rafter pivotally attached to the upper hub in a manner allowing the rafters to pivot in their respective rafter planes. The framework is characterized in that the framework deployed has the tracks in a common plane substantially orthogonal to the first axis, defining, with the lower hub, a structure floor, has the masts each at substantially a right angle to the joined track, adjacent masts defining structure walls, and the rafters at an obtuse angle to the joined masts such that the axes of the upper and lower hubs remain coaxial, the rafters and upper hub defining a structure roof.

In preferred embodiments the framework when folded comprises a package with the upper and lower hubs at a first and a second opposite end of the package, spaced apart by the length of a rafter, the rafter length being the longest of the rafter, mast or track length, with each set of joined rafters, masts, and tracks folded side by side within the package defined by the size of the upper and lower hubs and the length of the rafters. In some preferred embodiments as well, the framework when deployed further comprises hub-to-track locking elements to lock the tracks and lower hub into a common plane. The hub-to-track locking elements may constitute at least one flange to which both tracks and lower hub may be affixed. There may also be two flanges translatable to clamp tracks and hubs in a common plane.

In some preferred embodiments of the invention the deployed framework further comprises locking elements to lock each set of joined track and mast into a right-angle relationship. These locking elements may comprise pins passing through openings in each of joined masts and tracks. In other cases the locking elements may be brackets that, affixed to each of a mast and a track, lock the pivot between mast and track.

In some embodiments of the invention there is a telescoping central post joined to the lower hub, and extendable toward the upper hub, away from the upper hub, or both. Also in some embodiments there are joining elements for joining one deployed framework to another deployed framework. In still other embodiments there is a through opening in the upper hub with an opening area of a significant portion of the overall footprint of the upper hub. In still other embodiments there is a closed cinch passing around each of the masts of the framework, such that the cinch, in the deployed framework when tightened limits the masts from pivoting relative to the tracks to which they are pivotally joined, by more than ninety degrees. In some cases there may be a mechanical mechanism for unfolding the framework for deployment, and the mechanical mechanism may be a line and pulley system.

In some embodiments of the framework of the invention pivotal attachment between tracks and masts comprises a pivotal and translatable unit connecting the tracks and masts, such that pivoting is accomplished and masts are also translatable through the unit, such that masts may be extended in a deployed framework to below the level of the co-planar tracks, simultaneously lowering the assembly of rafters and upper hub.

In other embodiments of the framework pivotal attachment between masts and rafters comprises a pivotal and translatable unit connecting the masts and rafters, such that pivoting is accomplished and rafters are also translatable through the unit, such that a roof defined by the rafters and the upper hub may be altered in pitch, flattened, and inverted.

In still other embodiments pivotal attachment between masts and rafters comprises a pivotal and translatable unit connecting the masts and rafters, such that pivoting is accomplished and masts are also translatable through the unit, such that a roof defined by the rafters and the upper hub may be lowered relative to the lower hub without lowering the masts below the level of the lower hub. In some cases all pivotal attachments between masts and tracks and masts and rafters comprise translation capability as well as pivotal capability, such that each pivotal and translatable unit provides fro relative translation between elements engaging the unit as well as pivoting. In other embodiments one or more additional lower hubs each having a set of tracks joined to the masts by pivotal and translatable units, the additional hub and track sets defining additional floors, are provided, such that multiple stories are provided by a single unit.

In another aspect of the present invention a modular structure is provided, comprising a foldable, deployable framework having a lower hub with a first central axis, a set of three or more equal-length tracks each having a first track end pivotally attached to the lower hub such that each track pivots in a separate track plane parallel to the first axis, a set of three or more masts of equal length the same as or less than the length of the tracks, the number of masts equal to the number of tracks, each mast having a first mast end pivotally attached at a second track end, opposite the first track end, to one of the three tracks such that the masts pivot in planes adjacent to and parallel to the planes of the attached tracks, a set of three or more rafters of equal length greater than the length of either masts or tracks, the number of rafters equal to the number of masts, each rafter having a first rafter end pivotally attached at a second mast end, opposite the first mast end, to one of the three masts, such that the rafters pivot in planes adjacent to and parallel to the pivot planes of the attached masts and tracks, and an upper hub having a second central axis coaxial with the first central axis of the lower hub, with each rafter pivotally attached to the upper hub in a manner allowing the rafters to pivot in their respective rafter planes, the framework deployed having the tracks in a common plane substantially orthogonal to the first axis, defining, with the lower hub, a structure floor, having the masts each at substantially a right angle to the joined track, adjacent masts defining structure walls, and having the rafters at an obtuse angle to the joined masts such that the axes of the upper and lower hubs remain coaxial, the rafters and upper hub defining a structure roof, a set of panels affixed to the tracks and lower hub, constituting a floor, and skins added to the defined walls and roof to complete an enclosed structure.

In some embodiments the skins comprise rigid panels. Also in some embodiments the upper hub comprises a through opening in the completed structure, providing a sky hatch opening. There may also be door and window openings in the skins added to the defined walls. Further still, there may be float elements added to the underside of the floor, providing ability for the structure to be water-borne.

In still another aspect of the invention a composite structure composed of modular units is provided, comprising two or more modular structures each comprising a foldable, deployable framework having a lower hub with a first central axis, a set of three or more equal-length tracks each having a first track end pivotally attached to the lower hub such that each track pivots in a separate track plane parallel to the first axis, a set of three or more masts of equal length the same as or less than the length of the tracks, the number of masts equal to the number of tracks, each mast having a first mast end pivotally attached at a second track end, opposite the first track end, to one of the three tracks such that the masts pivot in planes adjacent to and parallel to the planes of the attached tracks, a set of three or more rafters of equal length greater than the length of either masts or tracks, the number of rafters equal to the number of masts, each rafter having a first rafter end pivotally attached at a second mast end, opposite the first mast end, to one of the three masts, such that the rafters pivot in planes adjacent to and parallel to the pivot planes of the attached masts and tracks, and an upper hub having a second central axis coaxial with the first central axis of the lower hub, with each rafter pivotally attached to the upper hub in a manner allowing the rafters to pivot in their respective rafter planes, the framework deployed having the tracks in a common plane substantially orthogonal to the first axis, defining, with the lower hub, a structure floor, having the masts each at substantially a right angle to the joined track, adjacent masts defining structure walls, and having the rafters at an obtuse angle to the joined masts such that the axes of the upper and lower hubs remain coaxial, the rafters and upper hub defining a structure roof, a set of panels affixed to the tracks and lower hub, constituting a floor, and skins added to the defined walls and roof to complete an enclosed structure, the modular structures physically joined to make the composite structure.

In some embodiments there are two or more modular structures joined side-by-side in a single-level composite with like-sized and shaped wall sections adjacent. In other embodiments two or more modular structures are joined at different levels with masts of one or more units at one level joined to masts of one or more units on a different level. In still other embodiments two or more structures are joined by overlapping floor area of one structure with floor area of another structure, and joining the two areas.

In another aspect of the invention a maritime unit is provided, wherein two or more of the modular structures are joined, each having a center post extending below floor level, further having a keel joined to the two or more center posts below floor level, and further having framing elements and skin elements forming a hull.

In yet another aspect of the present invention a foldable, deployable framework for a structure is provided, comprising a lower hub having a first central axis, a set of three or more equal-length tracks each having a first track end pivotally attached to the lower hub such that each track pivots in a separate track plane parallel to the first axis, a set of three or more masts of equal length, the number of masts equal to the number of tracks, each mast having a first mast end pivotally and translatably attached to one of the three tracks such that the masts pivot on the tracks in planes parallel to the planes of the attached tracks, and the first mast ends are free to translate along the length of the joined track, a set of three or more rafters of equal length greater than the length of either masts or tracks, the number of rafters equal to the number of masts, each rafter having a first rafter end pivotally attached at a second mast end, opposite the first mast end, to one of the three masts, such that the rafters pivot in planes adjacent to and parallel to the pivot planes of the attached masts and tracks, and an upper hub having a second central axis coaxial with the first central axis of the lower hub, with each rafter pivotally attached to the upper hub in a manner allowing the rafters to pivot in their respective rafter planes. The framework deployed has the tracks in a common plane substantially orthogonal to the first axis, defining, with the lower hub, a structure floor, has the masts each at substantially a right angle to the joined track, at an end of the tracks furthest from the lower hub, adjacent masts defining structure walls, and the rafters at an obtuse angle to the joined masts such that the axes of the upper and lower hubs remain coaxial, the rafters and upper hub defining a structure roof.

In some preferred embodiments there are locking elements between the first mast ends and the tracks enabled to lock the translation of the first mast ends at any position along a joined track. Also in some the framework folded comprises a package with the first mast ends translated to a position adjacent the lower hub and locked in that position, and the masts, tracks, and rafters pivoted to lie adjacent lengthwise, forming a package of outer cross-section defined by the hubs, and length defined by the rafter length.

In some cases the deployed framework further comprises hub-to-track locking elements to lock the tracks and lower hub into a common plane, and locking elements may be at least one flange to which both tracks and lower hub may be affixed. In some cases there are two flanges translatable to clamp tracks and hubs in a common plane.

In some embodiments the deployed framework further comprises locking elements to lock each set of joined track and mast into a right-angle relationship. The locking elements may comprise pins passing through openings in each of joined masts and tracks, or they may be brackets that, affixed to each of a mast and a track, lock the pivot between mast and track.

In some embodiments there may be a telescoping central post joined to the lower hub, and extendable toward the upper hub, away from the upper hub, or both. Further there may be joining elements for joining one deployed framework to another deployed framework. Still further there may be a through opening in the upper hub with an opening area of a significant portion of the overall footprint of the upper hub. In some cases there will be a closed cinch passing around each of the masts of the framework, such that the cinch, in the deployed framework, limits the masts from pivoting relative to the tracks to which they are pivotally joined, by more than ninety degrees. Still further, there may be a mechanical mechanism for unfolding the framework for deployment, which may be a line and pulley system.

In some embodiments of the invention pivotal attachment between tracks and masts comprises a pivotal and translatable unit connecting the tracks and masts, such that pivoting is accomplished and masts are also translatable through the unit, such that masts may be extended in a deployed framework to below the level of the co-planar tracks, simultaneously lowering the assembly of rafters and upper hub. In other embodiments pivotal attachment between masts and rafters comprises a pivotal and translatable unit connecting the masts and rafters, such that pivoting is accomplished and rafters are also translatable through the unit, such that a roof defined by the rafters and the upper hub may be altered in pitch, flattened, and inverted. In still other embodiments pivotal attachment between masts and rafters comprises a pivotal and translatable unit connecting the masts and rafters, such that pivoting is accomplished and masts are also translatable through the unit, such that a roof defined by the rafters and the upper hub may be lowered relative to the lower hub without lowering the masts below the level of the lower hub.

In some cases all pivotal attachments between masts and tracks and masts and rafters comprise translation capability as well as pivotal capability, such that each pivotal and translatable unit provides fro relative translation between elements engaging the unit as well as pivoting.

Also in some embodiments one or more additional lower hubs are provided each having a set of tracks joined to the masts by pivotal and translatable units, the additional hub and track sets defining additional floors, such that multiple stories are provided by a single unit.

In yet another aspect of the present invention a modular structure is provided, comprising a foldable, deployable framework having a lower hub having a first central axis, a set of three or more equal-length tracks each having a first track end pivotally attached to the lower hub such that each track pivots in a separate track plane parallel to the first axis, a set of three or more masts of equal length, the number of masts equal to the number of tracks, each mast having a first mast end pivotally and translatably attached to one of the three tracks such that the masts pivot on the tracks in planes parallel to the planes of the attached tracks, and the first mast ends are free to translate along the length of the joined track, a set of three or more rafters of equal length greater than the length of either masts or tracks, the number of rafters equal to the number of masts, each rafter having a first rafter end pivotally attached at a second mast end, opposite the first mast end, to one of the three masts, such that the rafters pivot in planes adjacent to and parallel to the pivot planes of the attached masts and tracks, and an upper hub having a second central axis coaxial with the first central axis of the lower hub, with each rafter pivotally attached to the upper hub in a manner allowing the rafters to pivot in their respective rafter planes, the framework deployed having the tracks in a common plane substantially orthogonal to the first axis, defining, with the lower hub, a structure floor, having the masts each at substantially a right angle to the joined track, at an end of the tracks furthest from the lower hub, adjacent masts defining structure walls, and having the rafters at an obtuse angle to the joined masts such that the axes of the upper and lower hubs remain coaxial, the rafters and upper hub defining a structure roof, a set of panels affixed to the tracks and lower hub, constituting a floor, and skins added to the defined walls and roof to complete an enclosed structure.

In some embodiments the skins comprise rigid panels. Also in some embodiments the upper hub comprises a through opening in the completed structure, providing a sky hatch opening. In still other embodiments there are door and window openings in the skin added to the defined walls.

Also in some cases there may be float elements added to the underside of the floor, providing ability for the structure to be water-borne.

In yet another aspect of the invention a composite structure composed of modular units is provided, comprising two or more modular structures each comprising a foldable, deployable framework having a lower hub having a first central axis, a set of three or more equal-length tracks each having a first track end pivotally attached to the lower hub such that each track pivots in a separate track plane parallel to the first axis, a set of three or more masts of equal length, the number of masts equal to the number of tracks, each mast having a first mast end pivotally and translatably attached to one of the three tracks such that the masts pivot on the tracks in planes parallel to the planes of the attached tracks, and the first mast ends are free to translate along the length of the joined track, a set of three or more rafters of equal length greater than the length of either masts or tracks, the number of rafters equal to the number of masts, each rafter having a first rafter end pivotally attached at a second mast end, opposite the first mast end, to one of the three masts, such that the rafters pivot in planes adjacent to and parallel to the pivot planes of the attached masts and tracks, and an upper hub having a second central axis coaxial with the first central axis of the lower hub, with each rafter pivotally attached to the upper hub in a manner allowing the rafters to pivot in their respective rafter planes, the framework deployed having the tracks in a common plane substantially orthogonal to the first axis, defining, with the lower hub, a structure floor, having the masts each at substantially a right angle to the joined track, at an end of the tracks furthest from the lower hub, adjacent masts defining structure walls, and having the rafters at an obtuse angle to the joined masts such that the axes of the upper and lower hubs remain coaxial, the rafters and upper hub defining a structure roof, a set of panels affixed to the tracks and lower hub, constituting a floor, and skins added to the defined walls and roof to complete an enclosed structure. This composite structure is characterized in that the modular structures are physically joined to make the composite structure.

In some cases two or more modular structures are joined side-by-side in a single-level composite with like-sized and shaped wall sections adjacent. In other cases two or more modular structures are joined at different levels with masts of one or more units at one level joined to masts of one or more units on a different level. In still other cases two or more structures are joined by overlapping floor area of one structure with floor area of another structure, and joining the two areas. In still other cases a maritime unit is provided, wherein two or more of the modular structures are joined, each having a center post extending below floor level, further comprising a keel joined to the two or more center posts below floor level, and further comprising framing elements and skin elements forming a hull.

BRIEF DESCRIPTION OF THE DRAWING FIGURES

Figure 8:
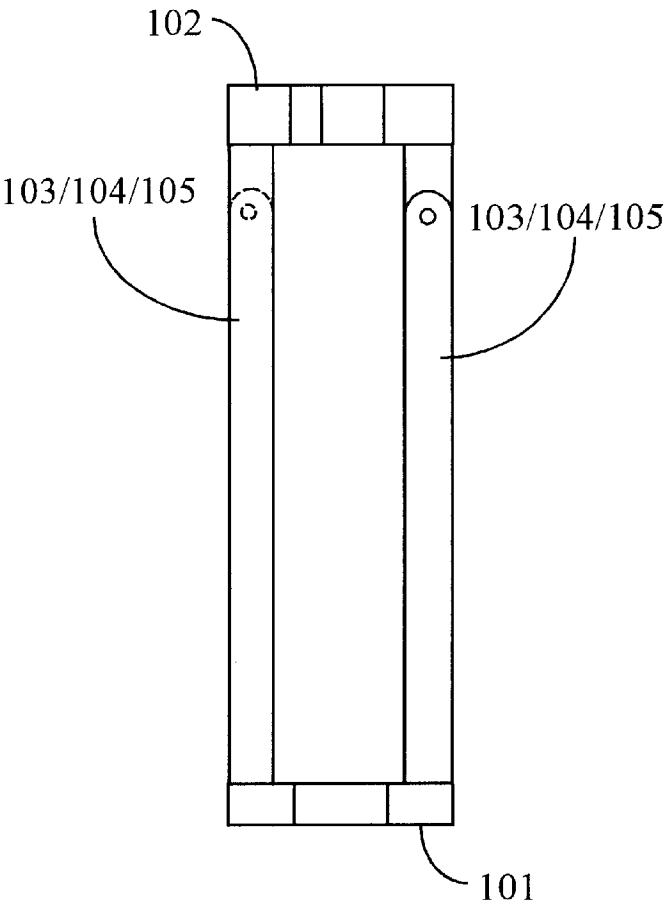

FIG. 8 is a view along the aspect of FIGS. 3 and 4 and 5 and 6 showing the framework folded to a fourth and final condition.

Figure 9:
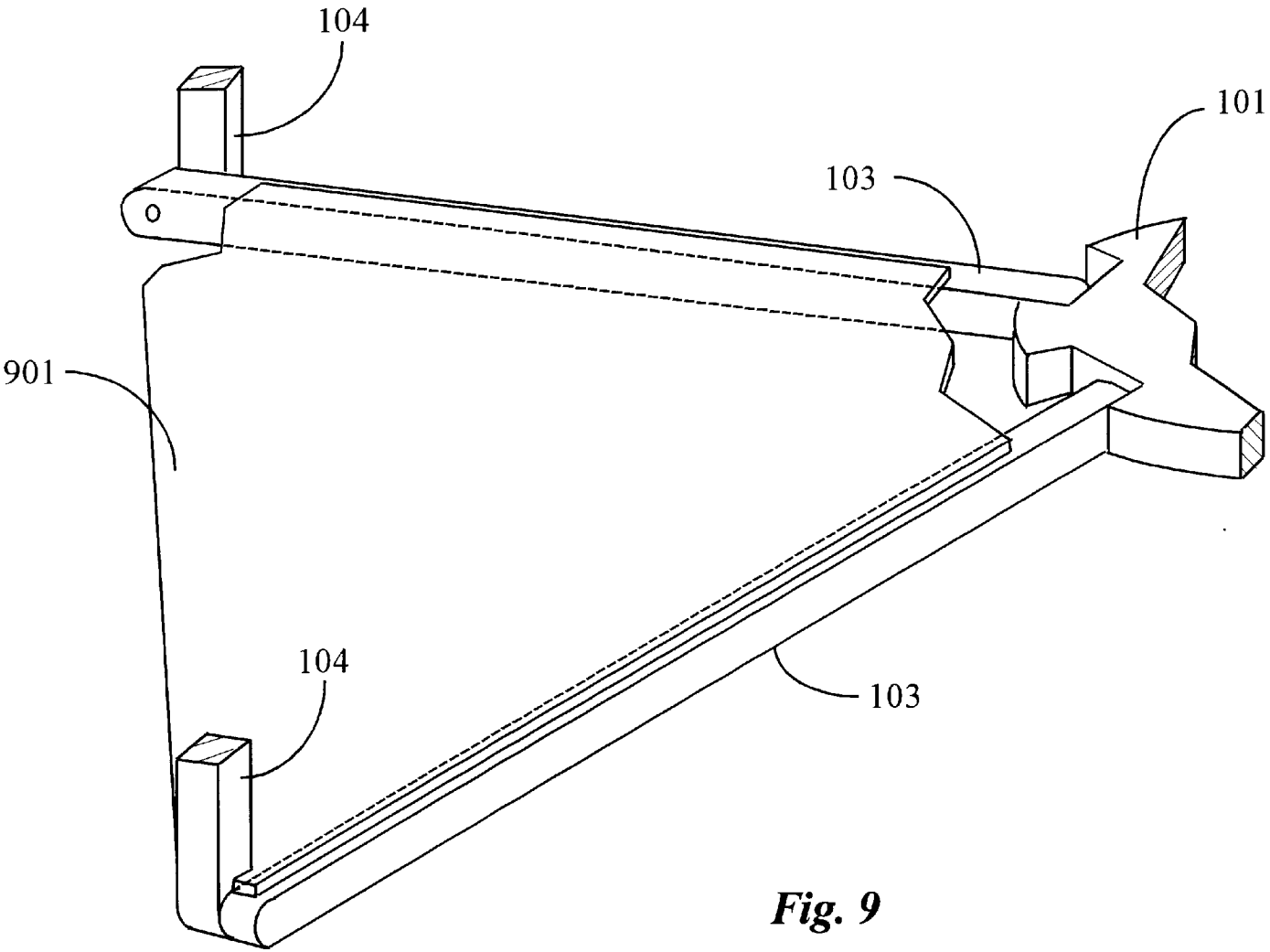

FIG. 9 illustrates two tracks for a folding framework, and a floor panel in an embodiment of the present invention.

Figure 10:
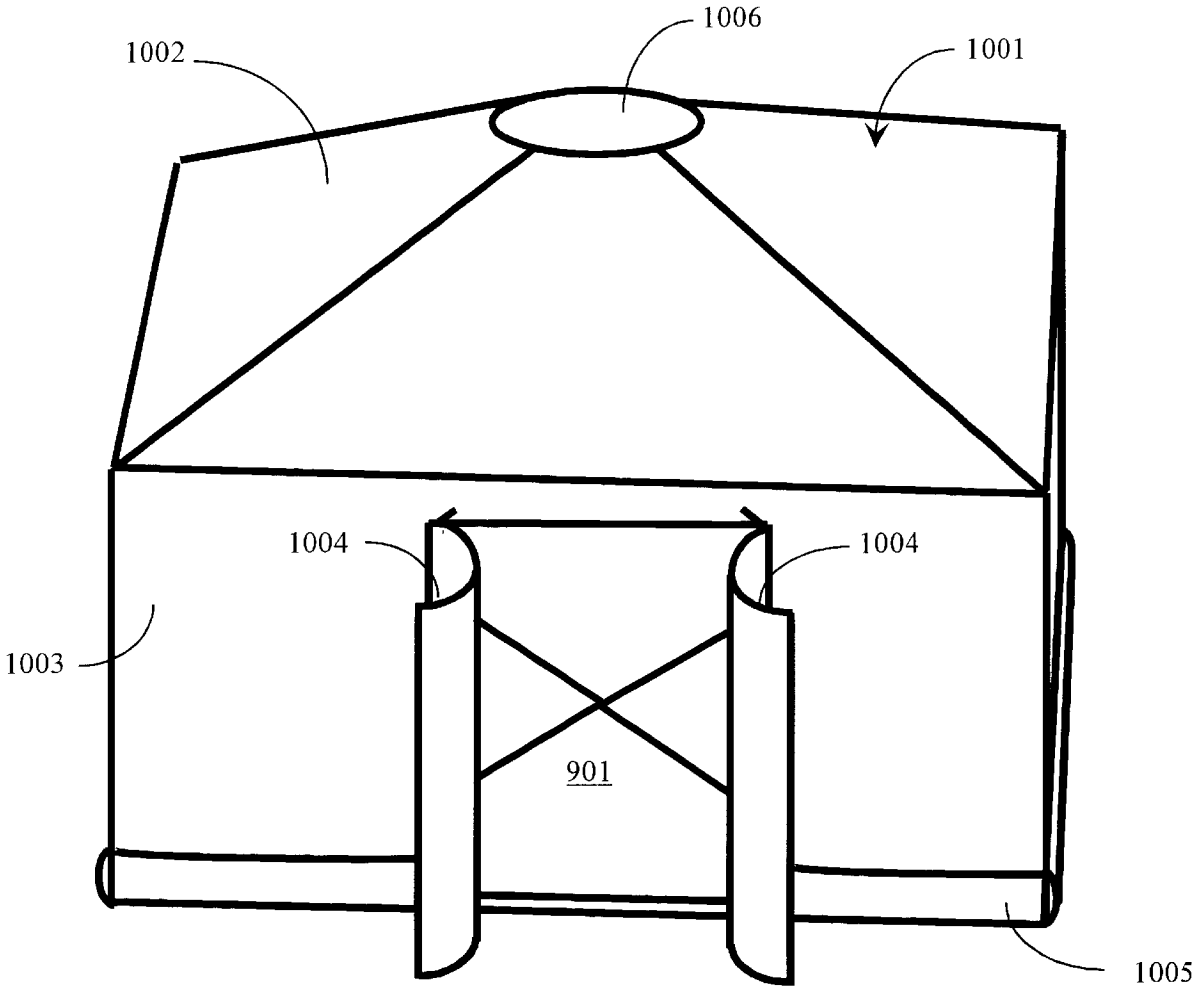

FIG. 10 is a perspective view of a deployed framework including an outer skin in an embodiment of the present invention.

Figure 11:
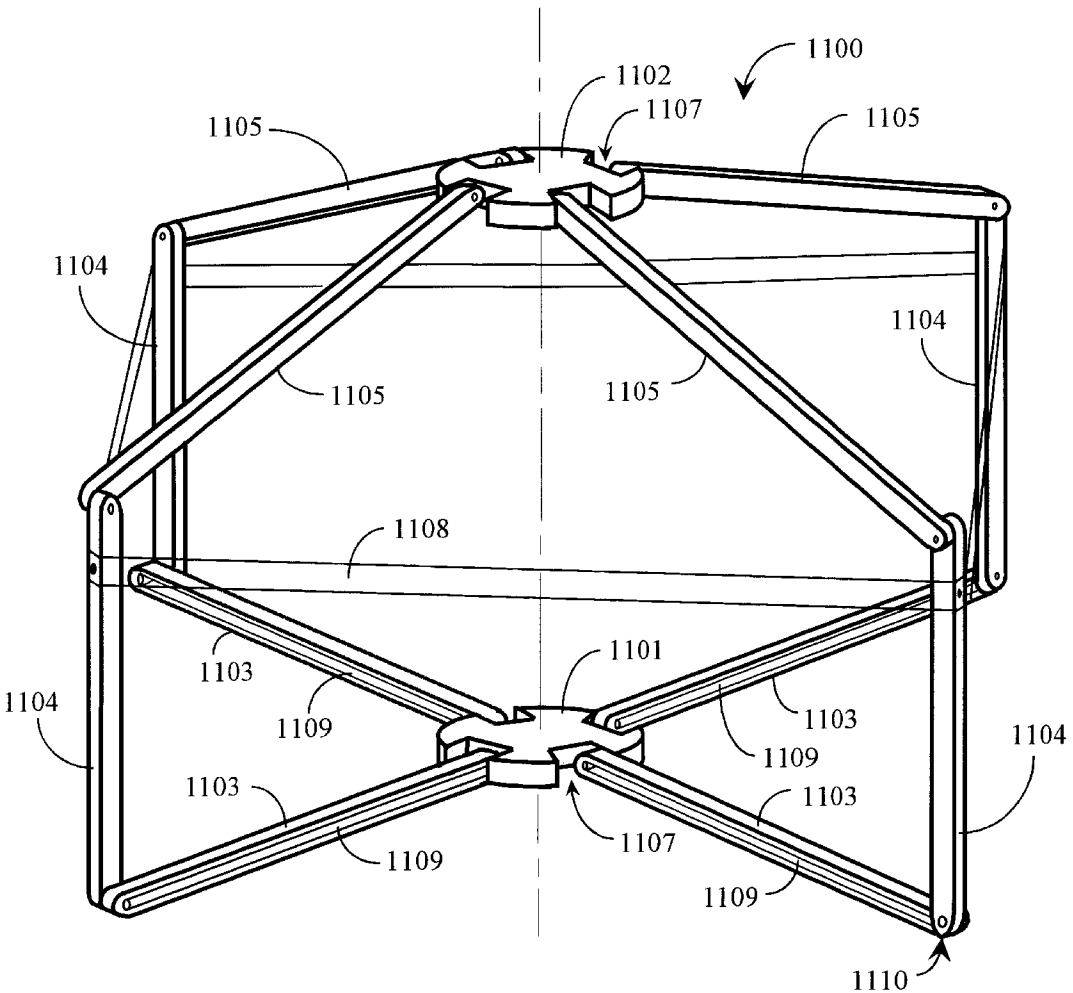

FIG. 11 is a perspective view of a folding framework in an alternative embodiment of the present invention.

Figure 12:
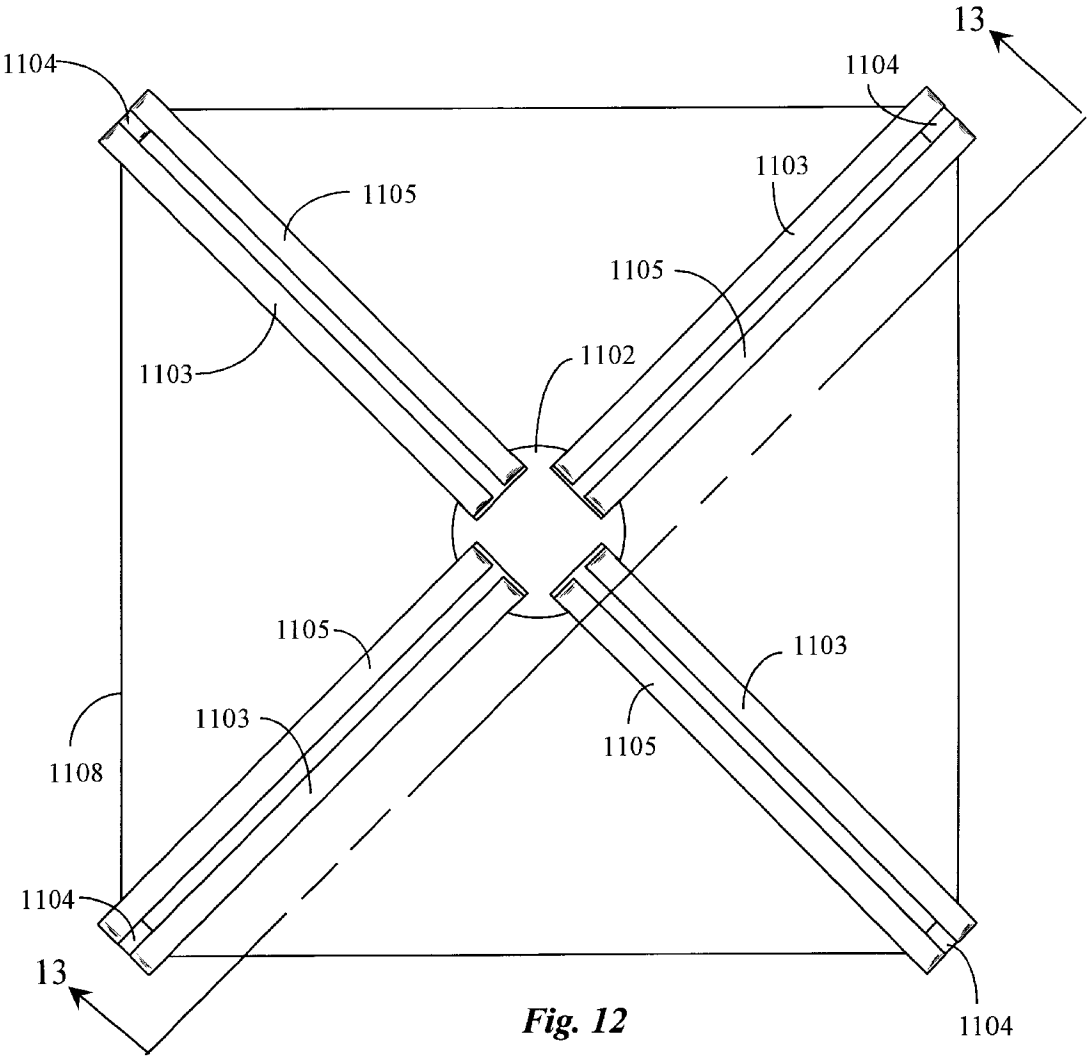

FIG. 12 is a plan view of the framework of FIG. 11.

Figure 13:
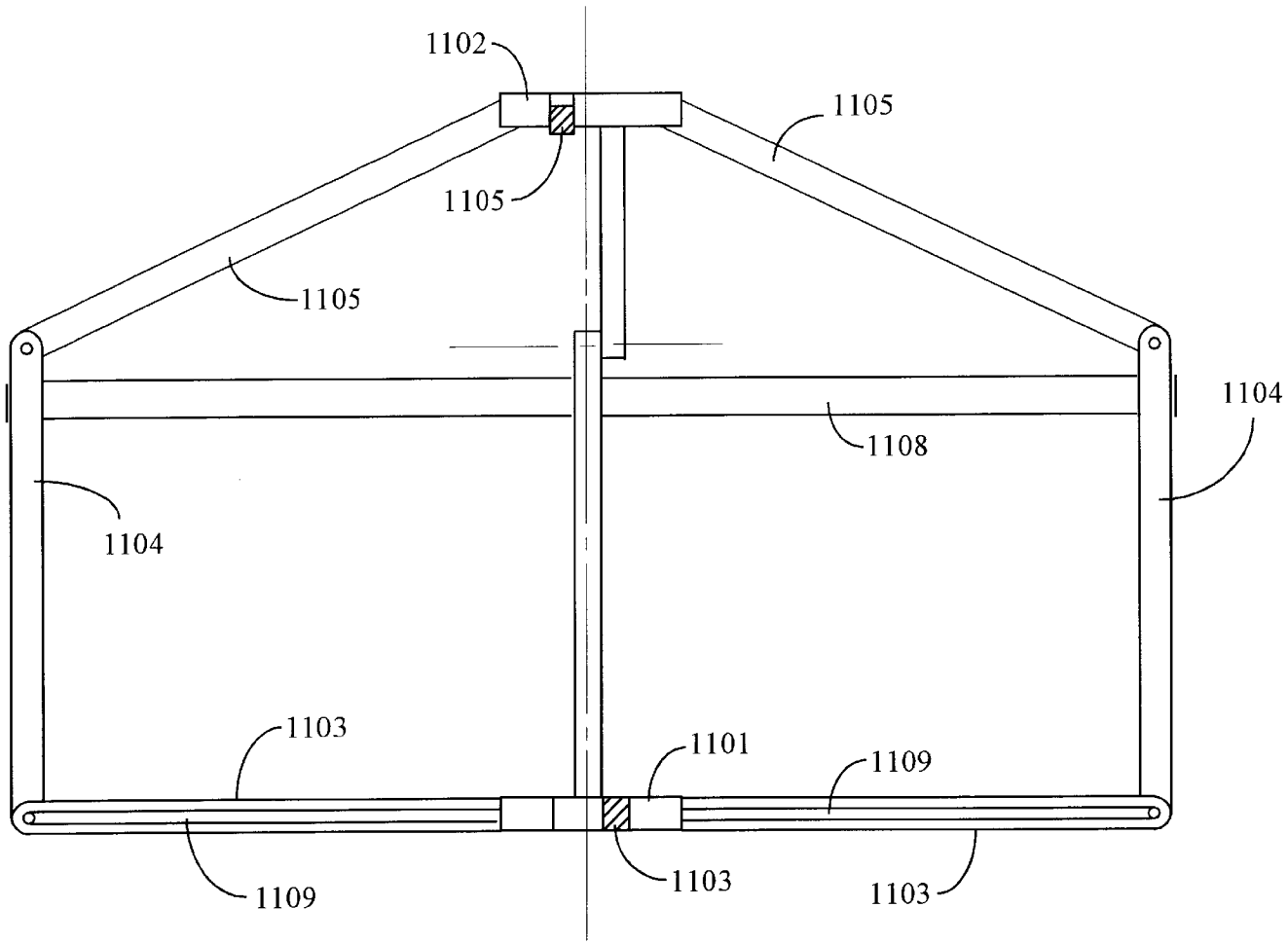

FIG. 13 is a section view of the framework of FIG. 12 taken along the section line 13—13 of FIG. 12.

Figure 14:
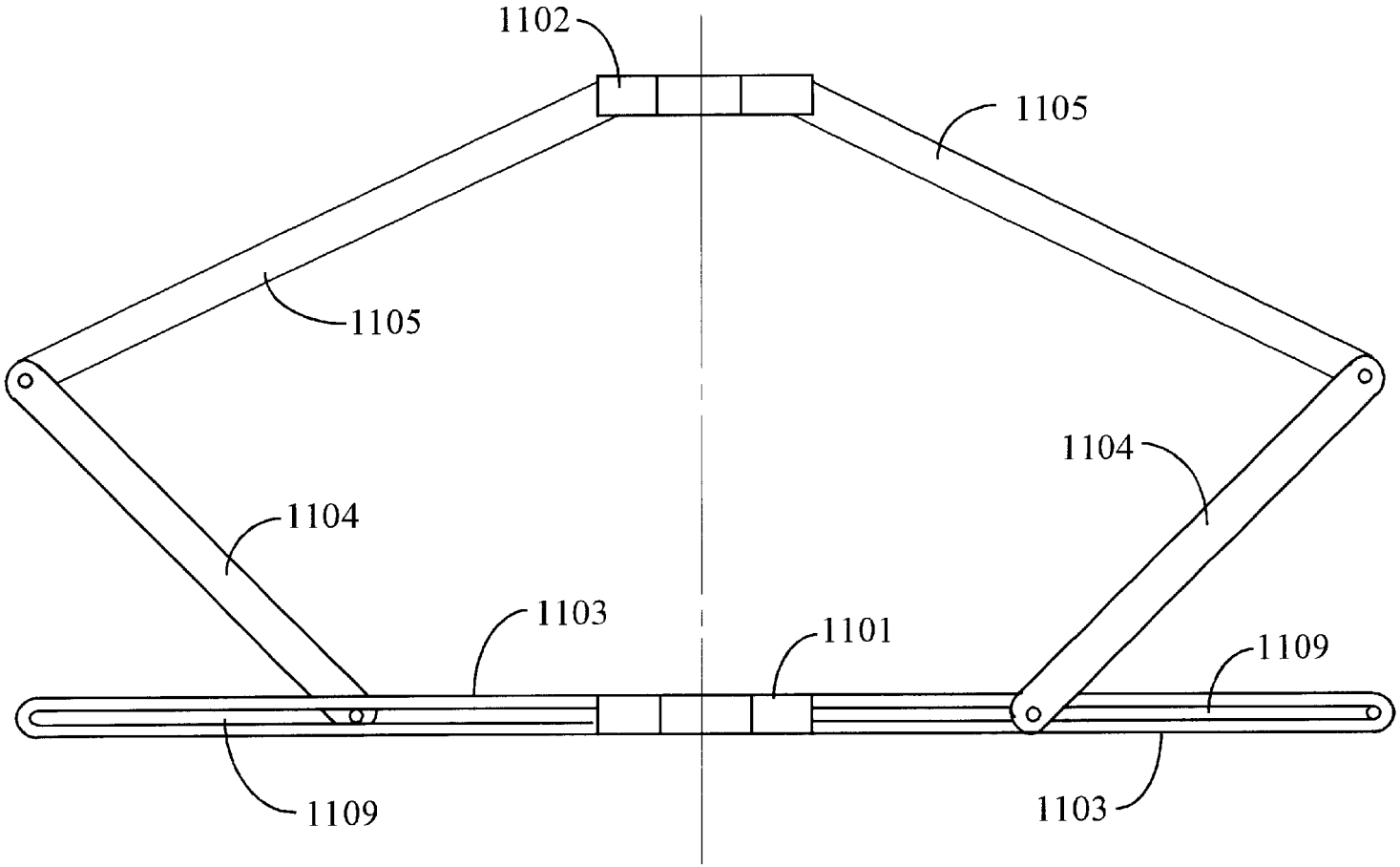

FIG. 14 illustrates a first step in folding the framework of FIG. 12 for storage or transport.

Figure 15:
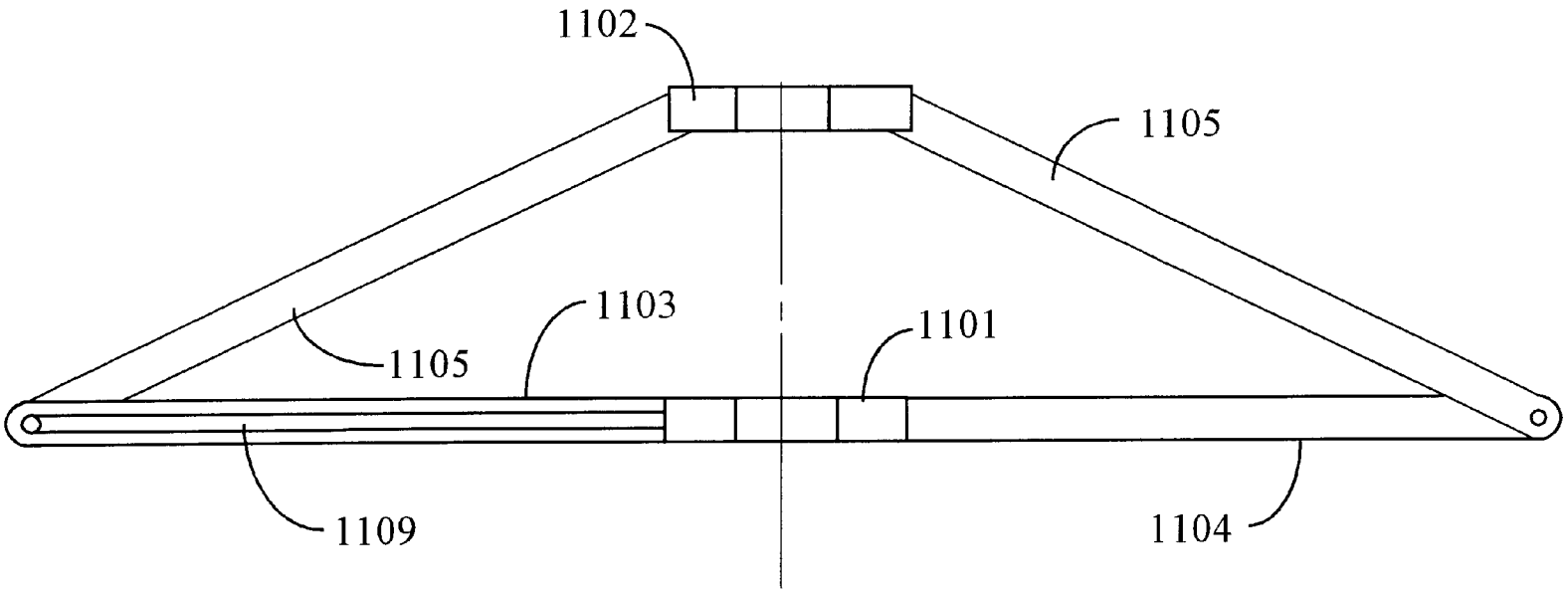

FIG. 15 illustrates another step in folding the framework of FIG. 12 for storage or transport.

Figure 16:
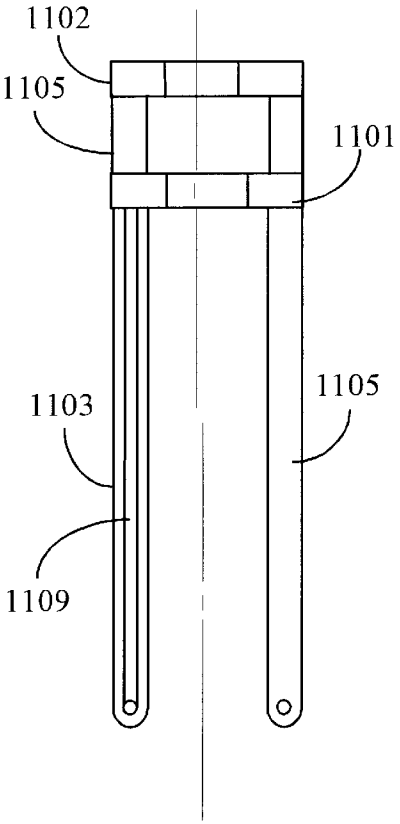

FIG. 16 shows the framework of FIG. 12 fully folded for transport or storage.

Figure 17:
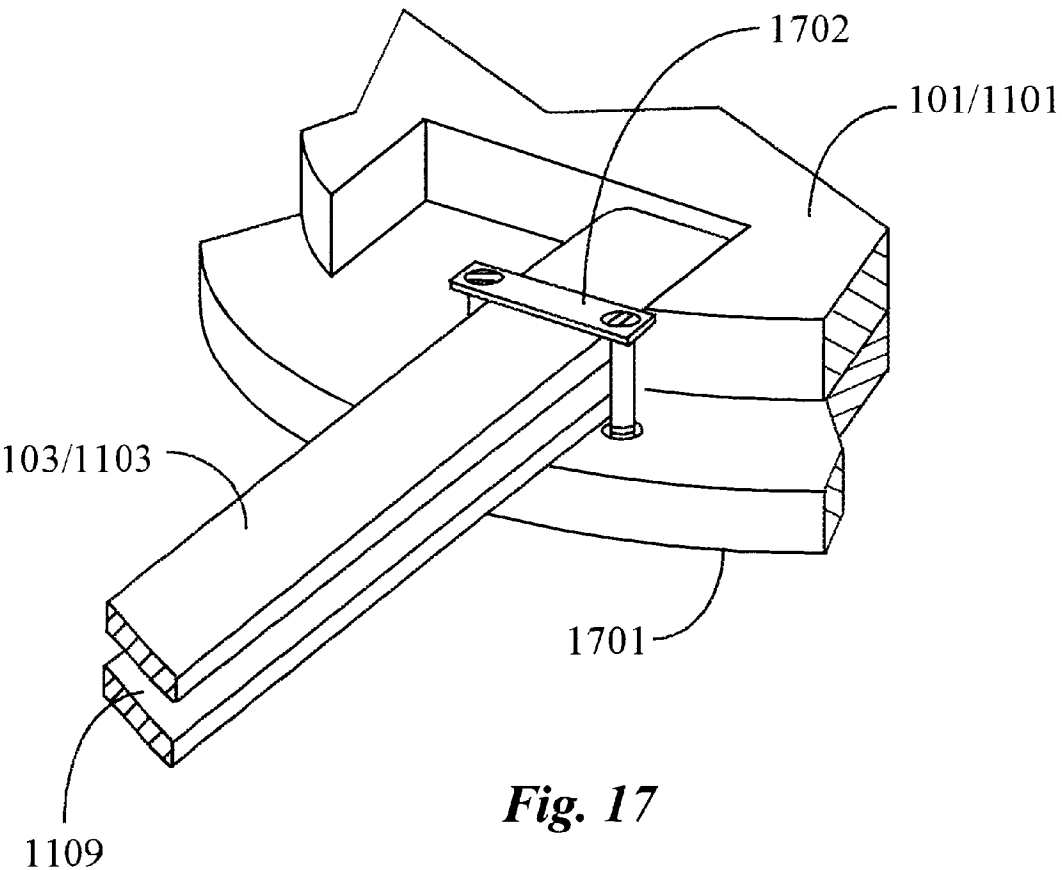

FIG. 17 illustrates one way to stabilize tracks to a lower hub in an embodiment of the invention.

Figure 18:
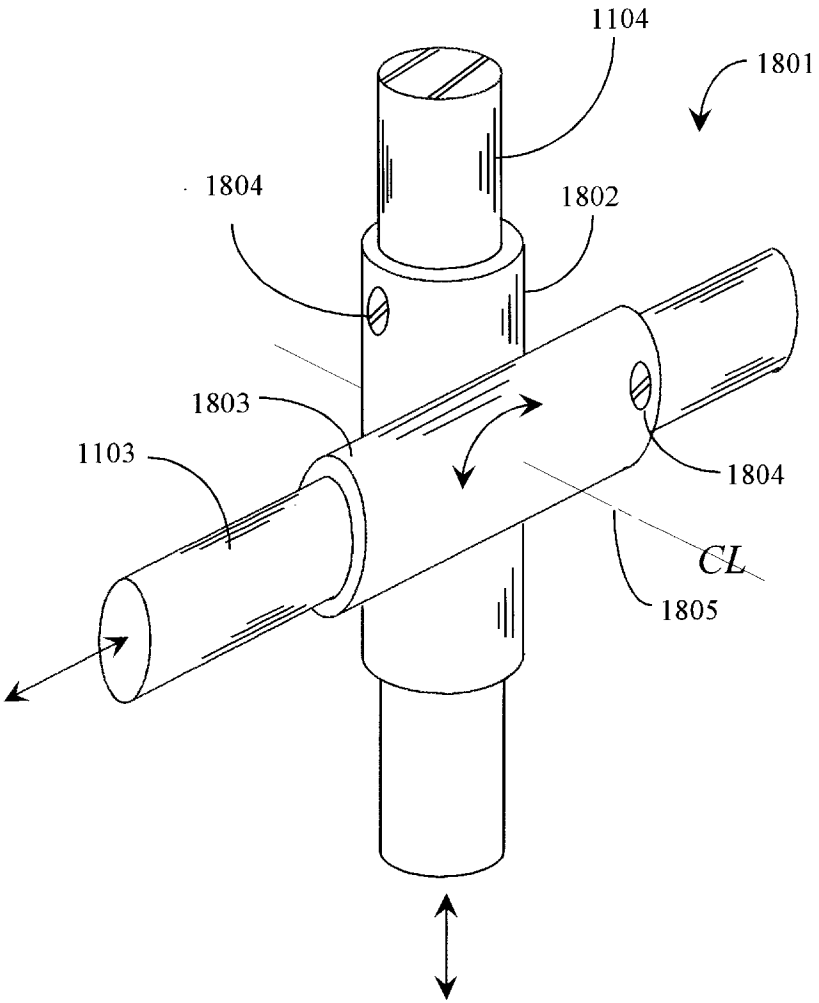

FIG. 18 shows a pivot and translation unit for joining structural elements in an embodiment of the invention.

Figure 19:
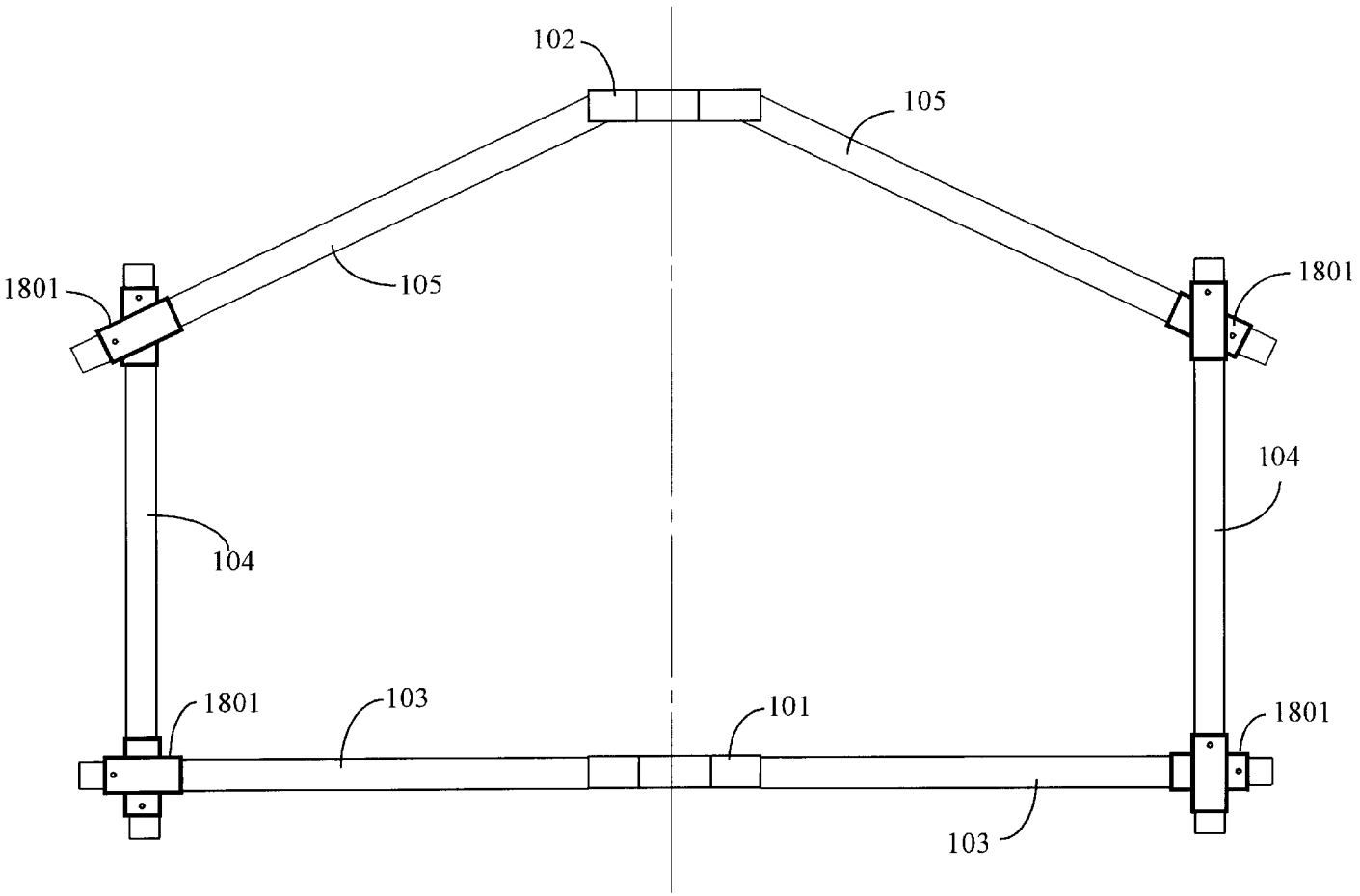

FIG. 19 illustrates a framework utilizing units shown in FIG. 18.

Figure 20:
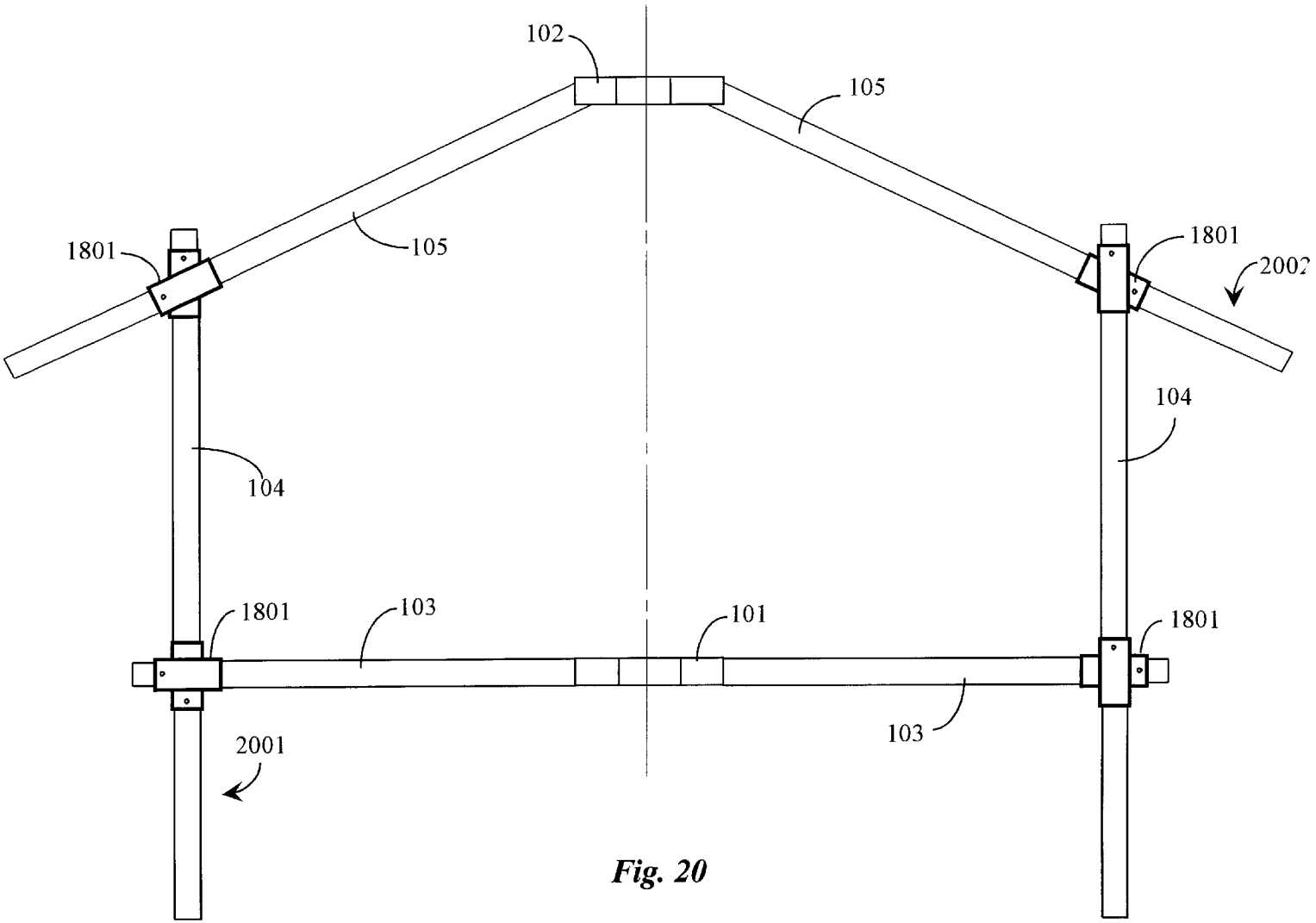

FIG. 20 shows an arrangement of a framework made possible by the units shown in FIGS. 18 and 19.

Figure 21:
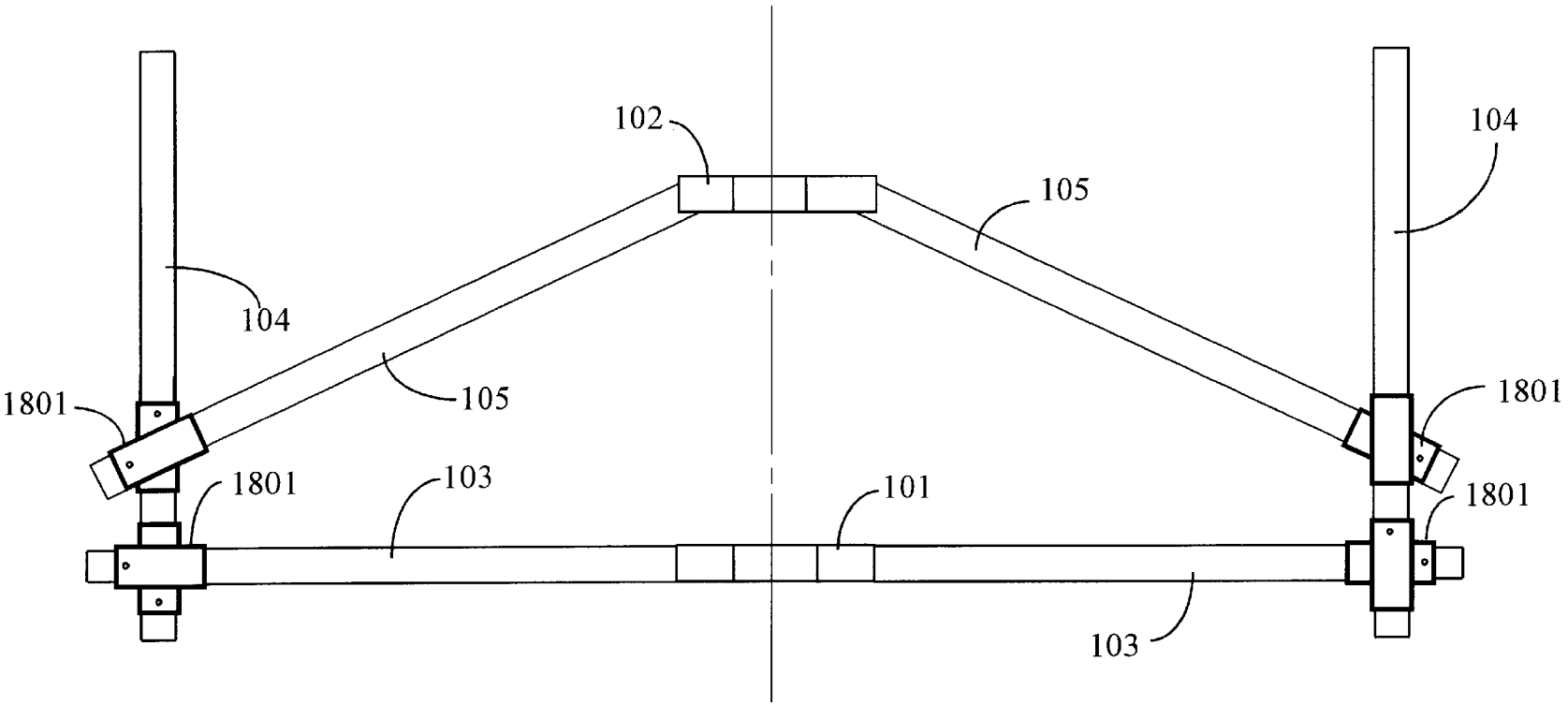

FIG. 21 shows another arrangement for the framework of FIG. 20.

Figure 22:
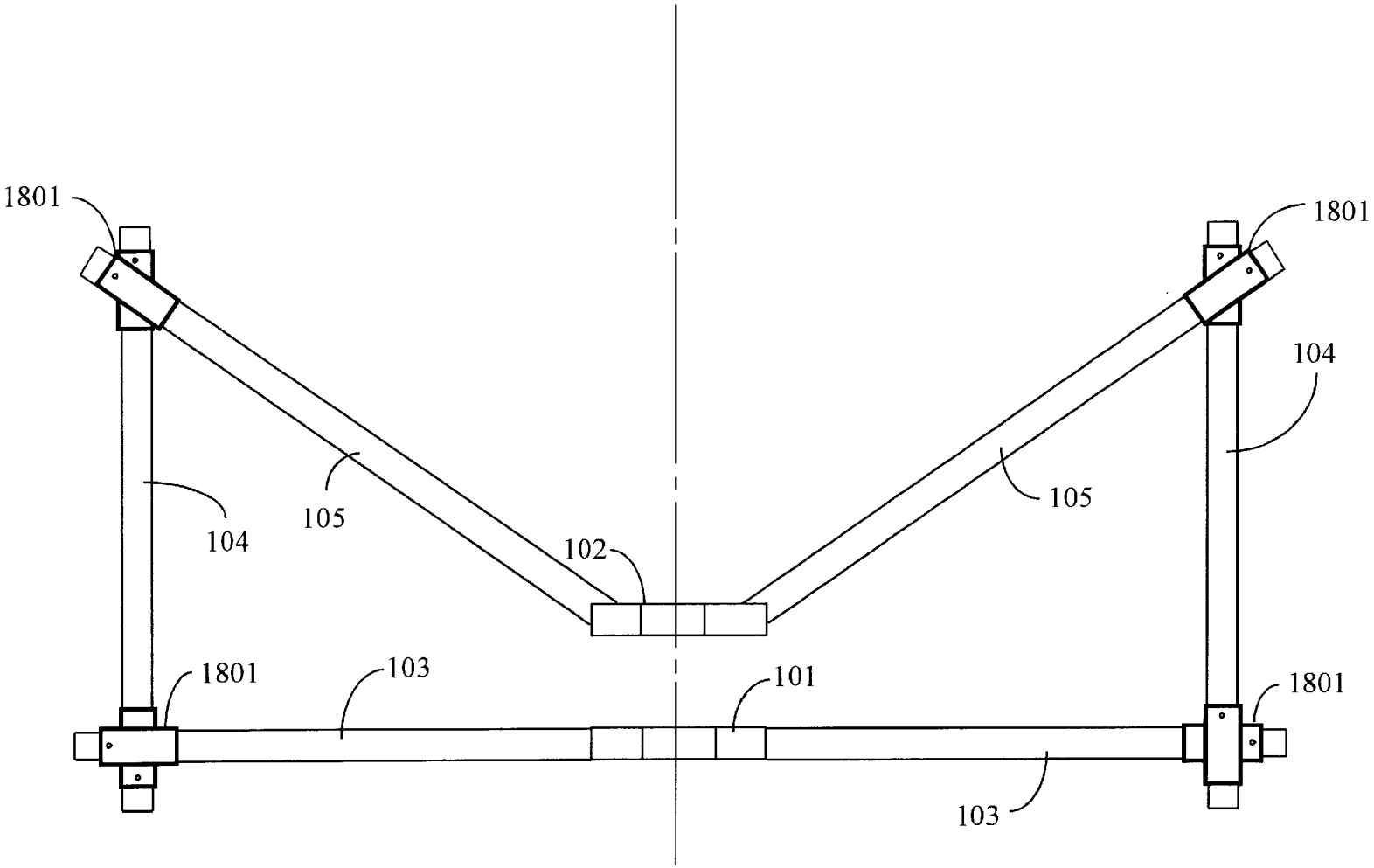

FIG. 22 shows yet another arrangement for the framework of FIG. 20.

Figure 23:
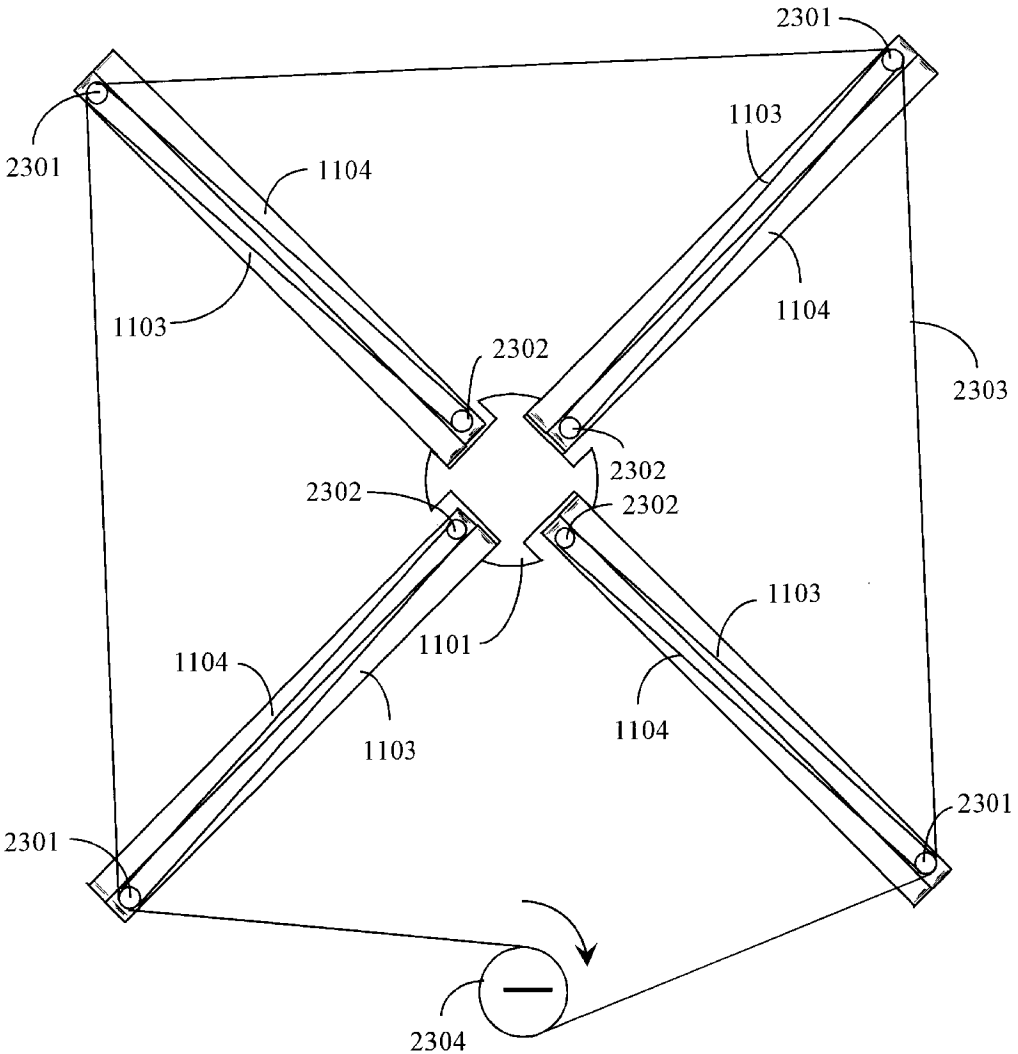

FIG. 23 illustrates a mechanical apparatus for deploying a framework in an embodiment of the invention.

Figure 24:
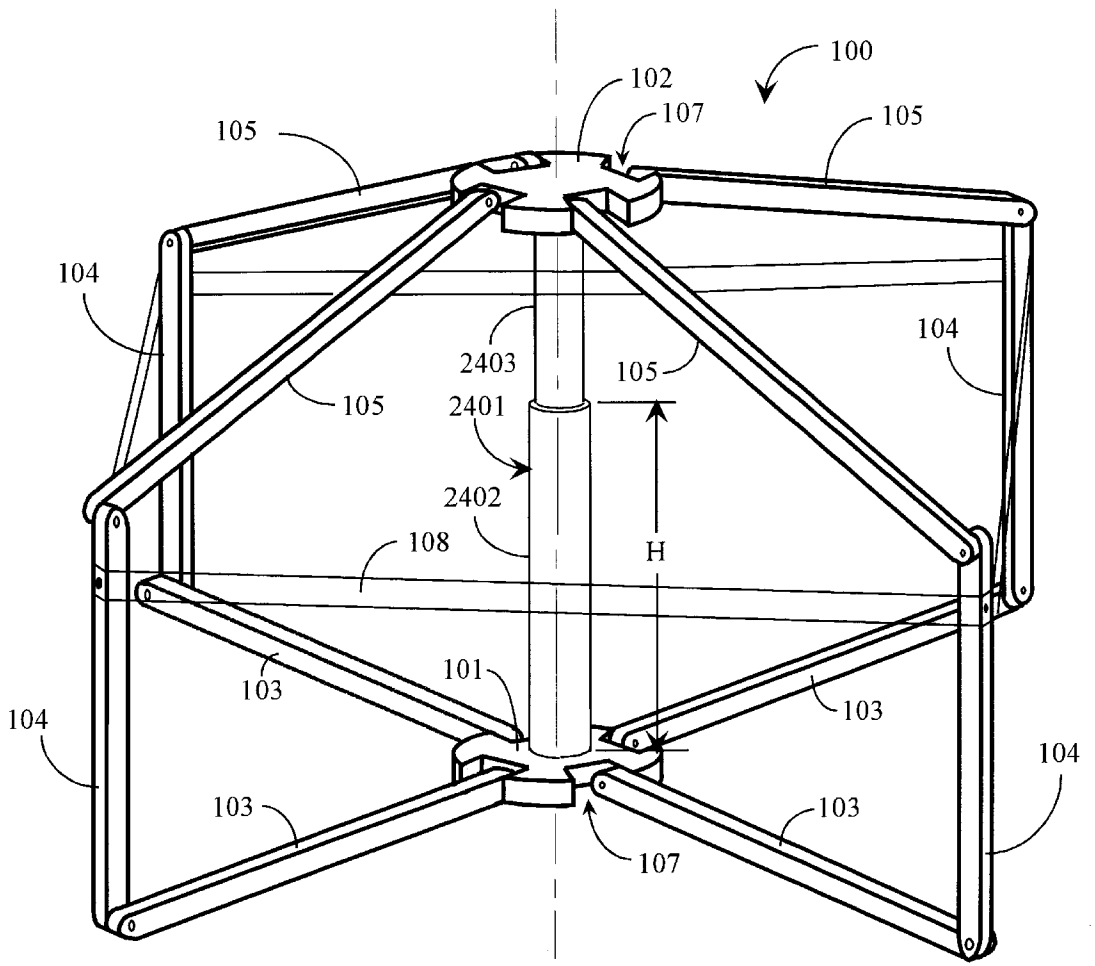

FIG. 24 illustrates a telescoping center post in an embodiment of the invention.

Figure 25:
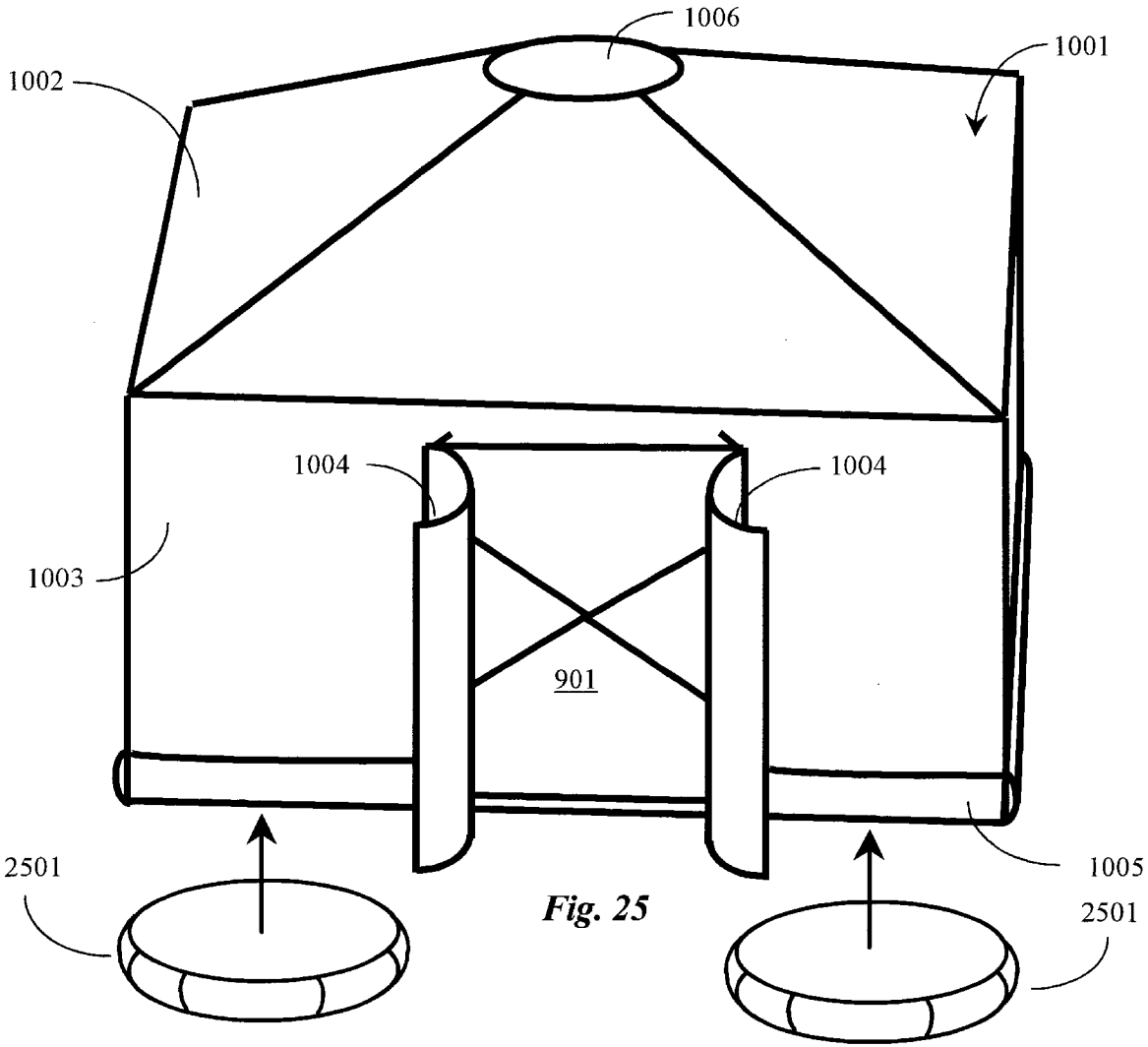

FIG. 25 shows a structure based on a in an embodiment of the invention, also enhanced with floats.

Figure 26:
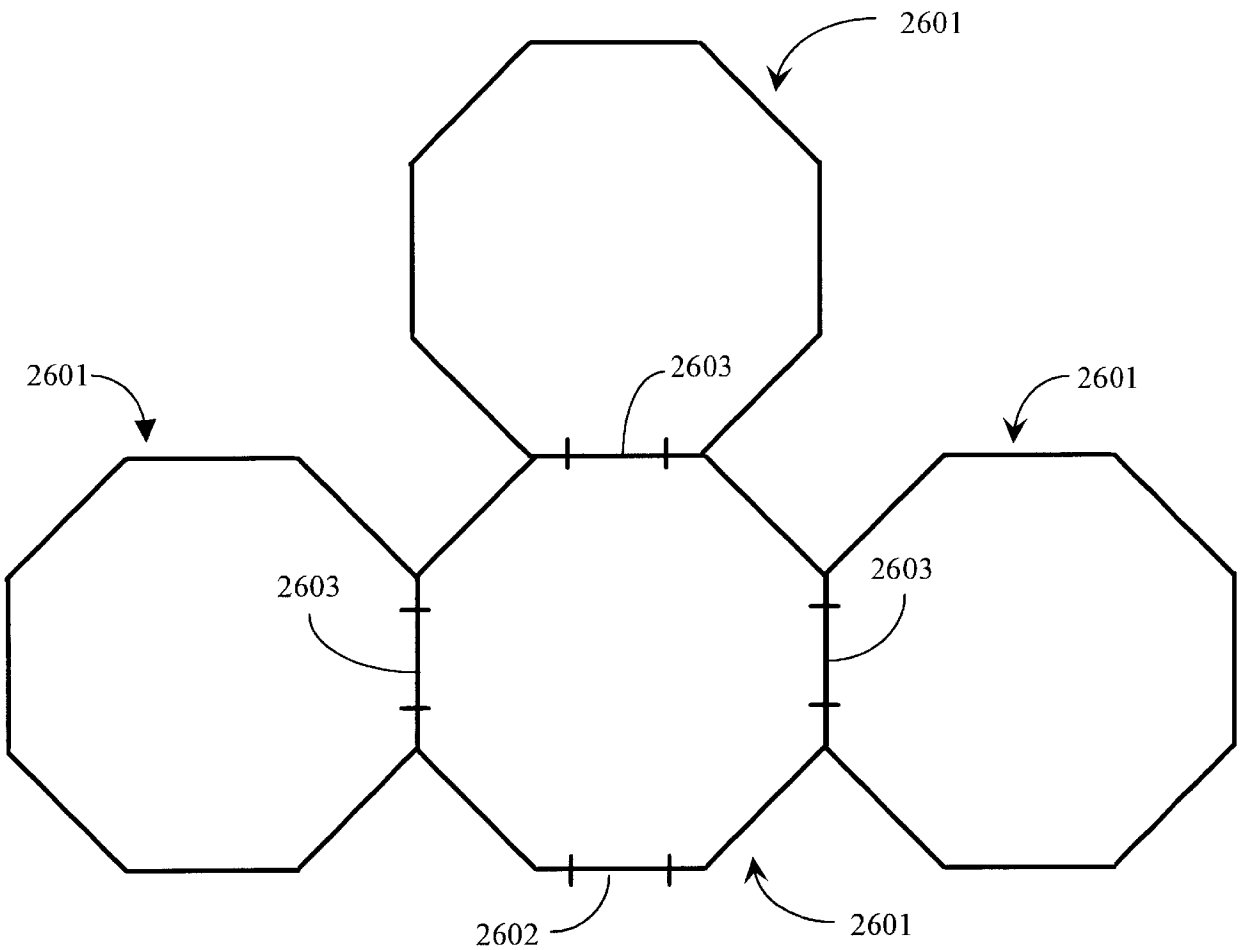

FIG. 26 is a plan view of outlines of joined structures in an embodiment of the invention.

Figure 27:
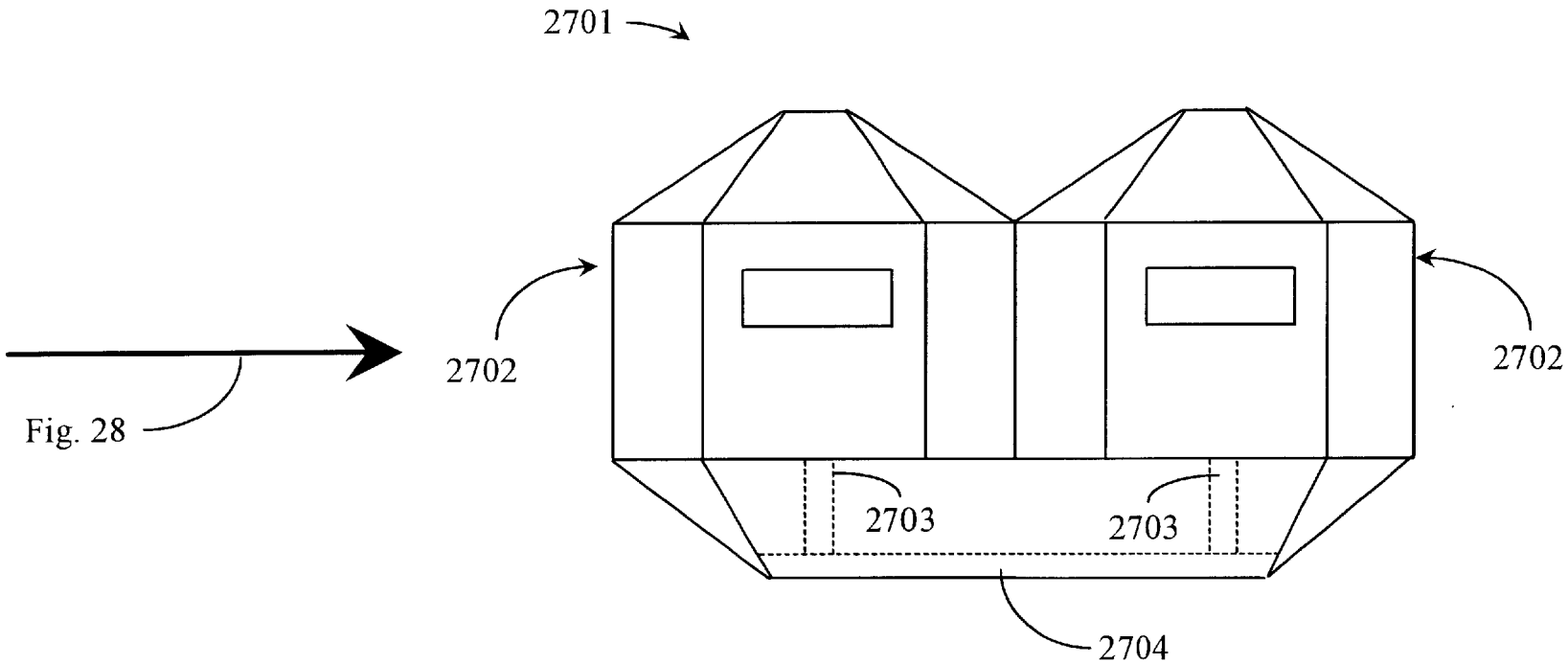

FIG. 27 is a side elevation view of a watercraft based on structures following embodiments of the invention.

Figure 28:
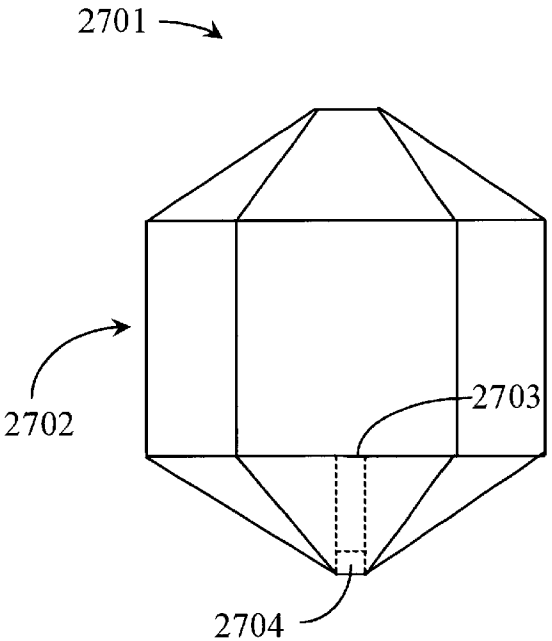

FIG. 28 is a head-on elevation view of the watercraft of FIG. 27.

Figure 29:
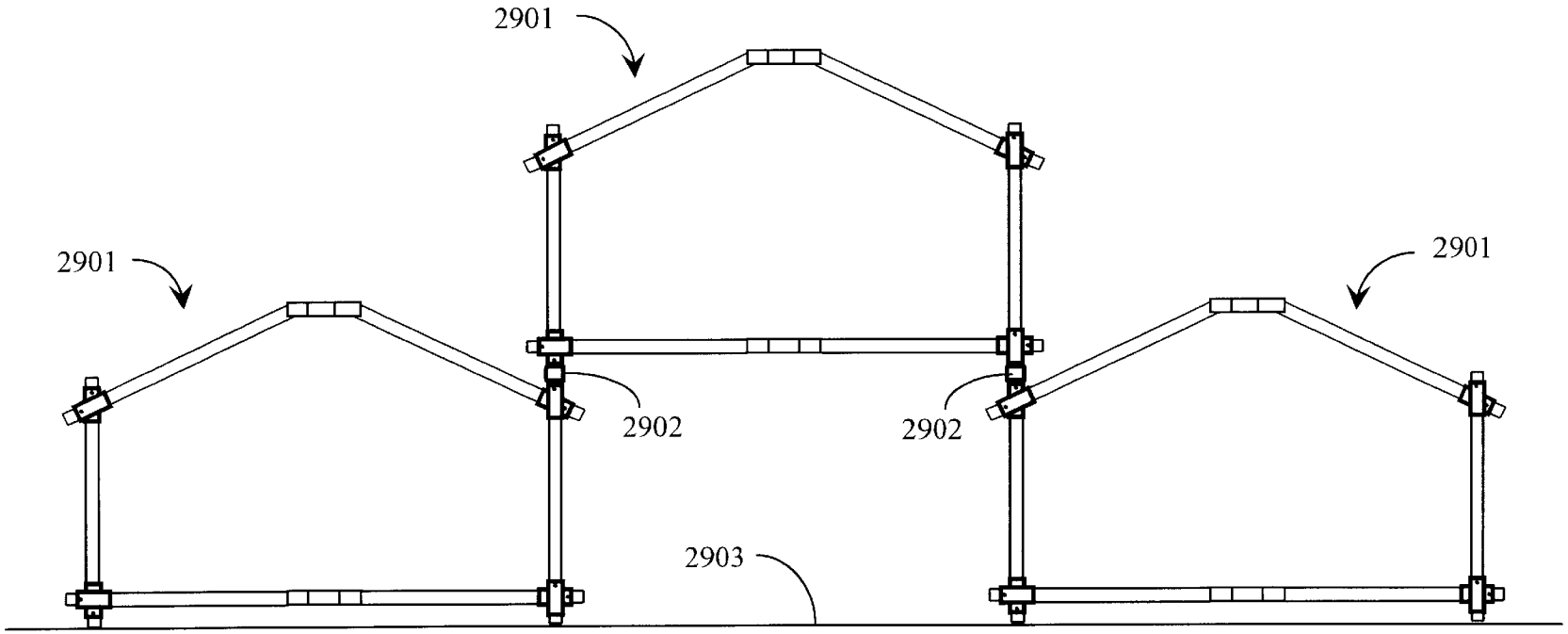

FIG. 29 is an elevation view of joined structures following embodiments of the present invention.

Figure 30:
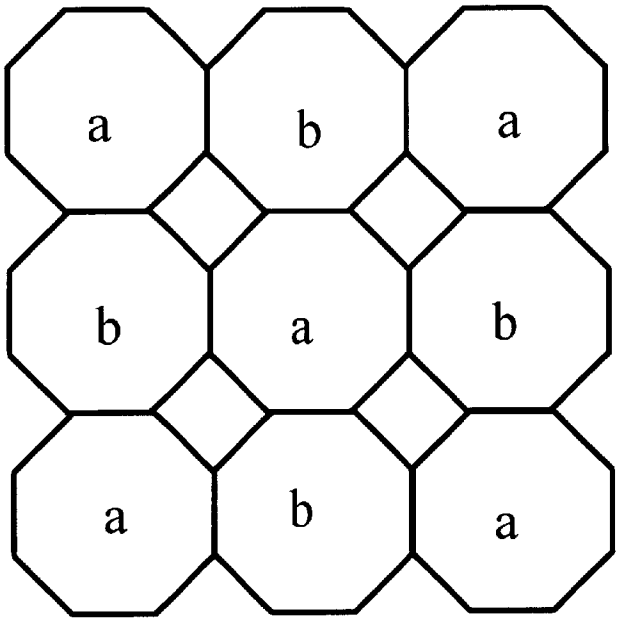

FIG. 30 is a plan view showing outlines of joined and staggered structures in an embodiment of the present invention.

Figure 31:
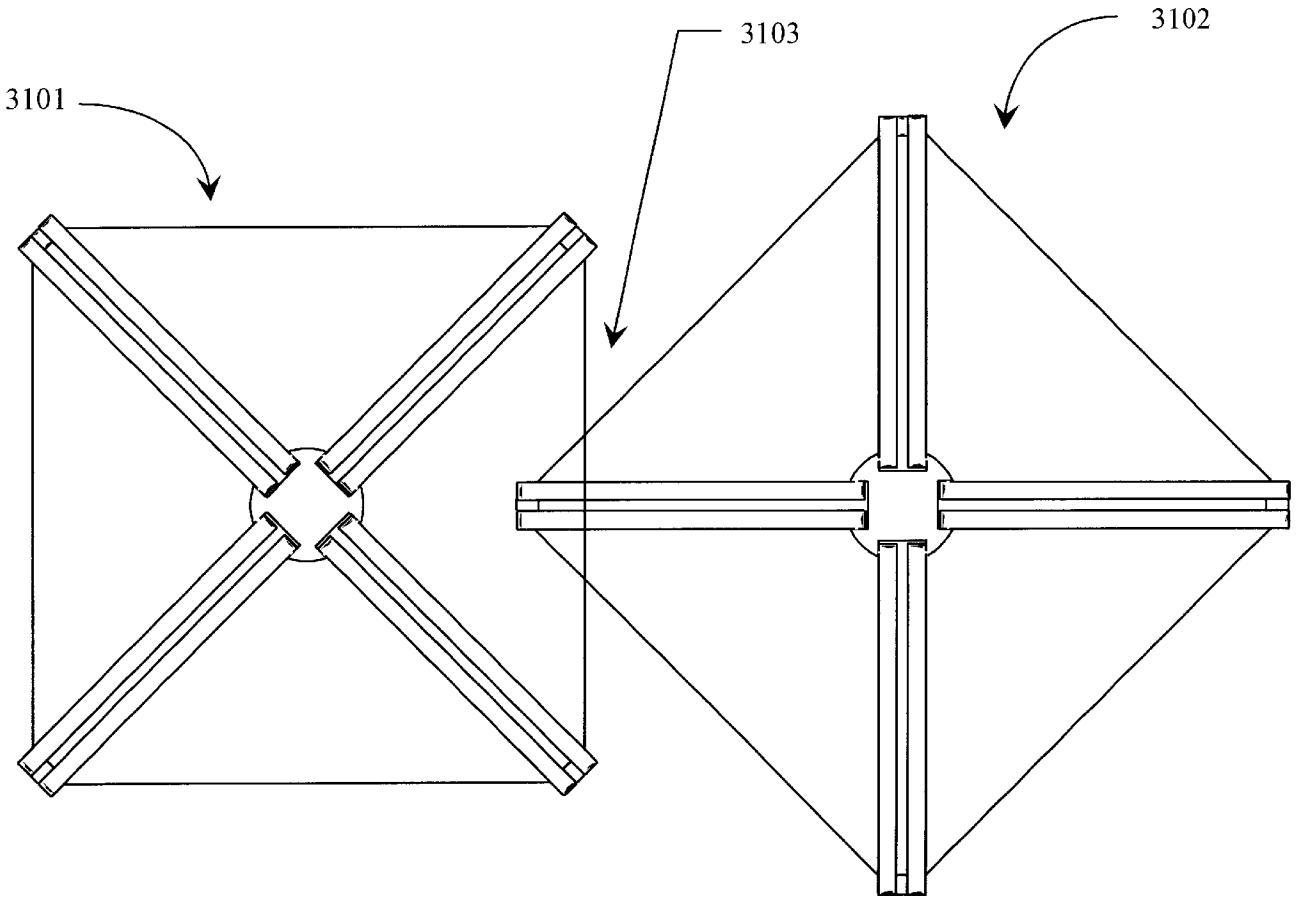

FIG. 31 is a plan view illustrating another way of joining structures in an embodiment of the present invention.

DESCRIPTION OF THE PREFERRED EMBODIMENTS

Figure 1:
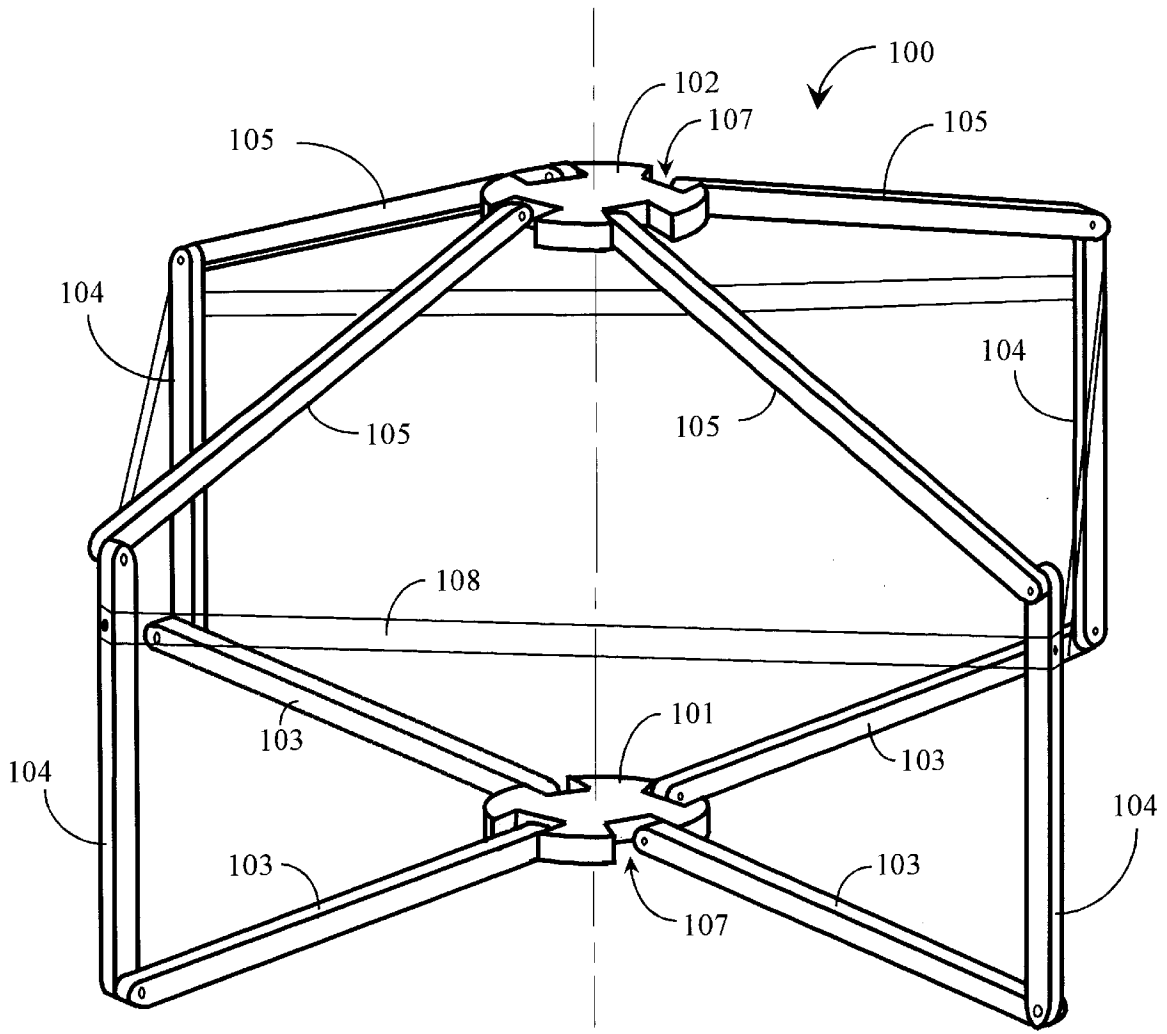
FIG. 1 is a perspective view of a foldable framework for a structure according to an embodiment of the present invention.

FIG. 1 is a perspective view of a foldable framework 100 for a structure according to a simple and basic embodiment of the present invention. This framework comprises an upper hub element 102 and a lower hub element 101, together with a matrix of interconnected frame elements, including four base tracks 103, four masts 104, and four rafters 105. Upper and lower hubs 102 and 101 respectively are identical in this embodiment, but need not be so in all embodiments.

In the simple embodiment shown, tracks 103 are pivotally joined at one end of each track to lower hub 101 within openings 107 provided for the purpose. The opposite end of each track 103 is pivotally joined to one end of each mast 104, each of which is in turn pivotally at the opposite end joined to one end of each rafter 105. Finally, rafters 105 are pivotally joined at opposite ends to upper hub 102 within openings 107 in hub 102.

In the embodiment shown the framing elements are arranged with pivots positioned such that hub 101 and tracks 103 define a horizontal plane, masts 104 are vertical with regard to their long axes, and rafters 105 define and obtuse angle with the vertical masts, ending at a peak position for hub 102. Arranged thusly, the elements provide a structural framework providing for an enclosure with a peaked roof. For this relationship, it is necessary that rafters 105 be somewhat longer than masts 104. A fabric cinch belt 108, arranged around the masts and contacting the masts at a common height in this embodiment provides a restraint such that masts 104 may all be vertical, but cannot each incline away from vertical to the outside of the enclosure defined by the framework.

Figure 2:
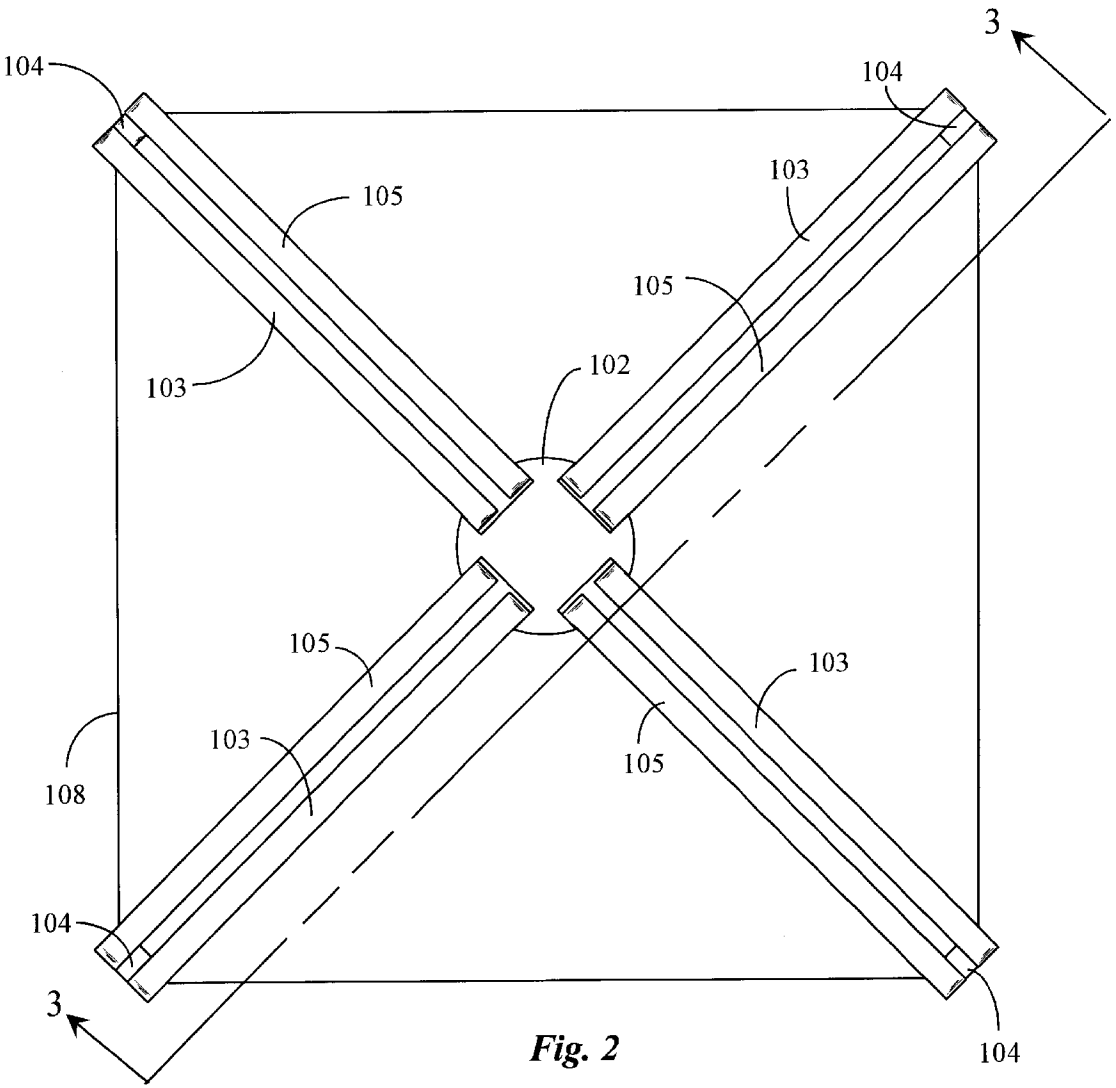
FIG. 2 is a plan view of the framework of FIG. 1.

FIG. 2 is a plan view of the framework of FIG. 1, looking directly down from above. As can be seen in FIG. 2, the structure defined has a square footprint, as the tracks 103 are each of equal length. This is not a requirement for the invention in general, but is a requirement in some embodiments of the invention. Generally speaking, if the tracks were not of equal length, the structure defined would have a footprint of a four-sided polygon, but not either square or rectangular.

Because hubs 102 and 101 are identical in footprint, hub 101 is not seen in the plan view. Horizontal tracks 103 that join to hub 101 are, however, clearly evident. Also, cinch 108 is seen as forming a square aspect in FIG. 2.

Figure 3:
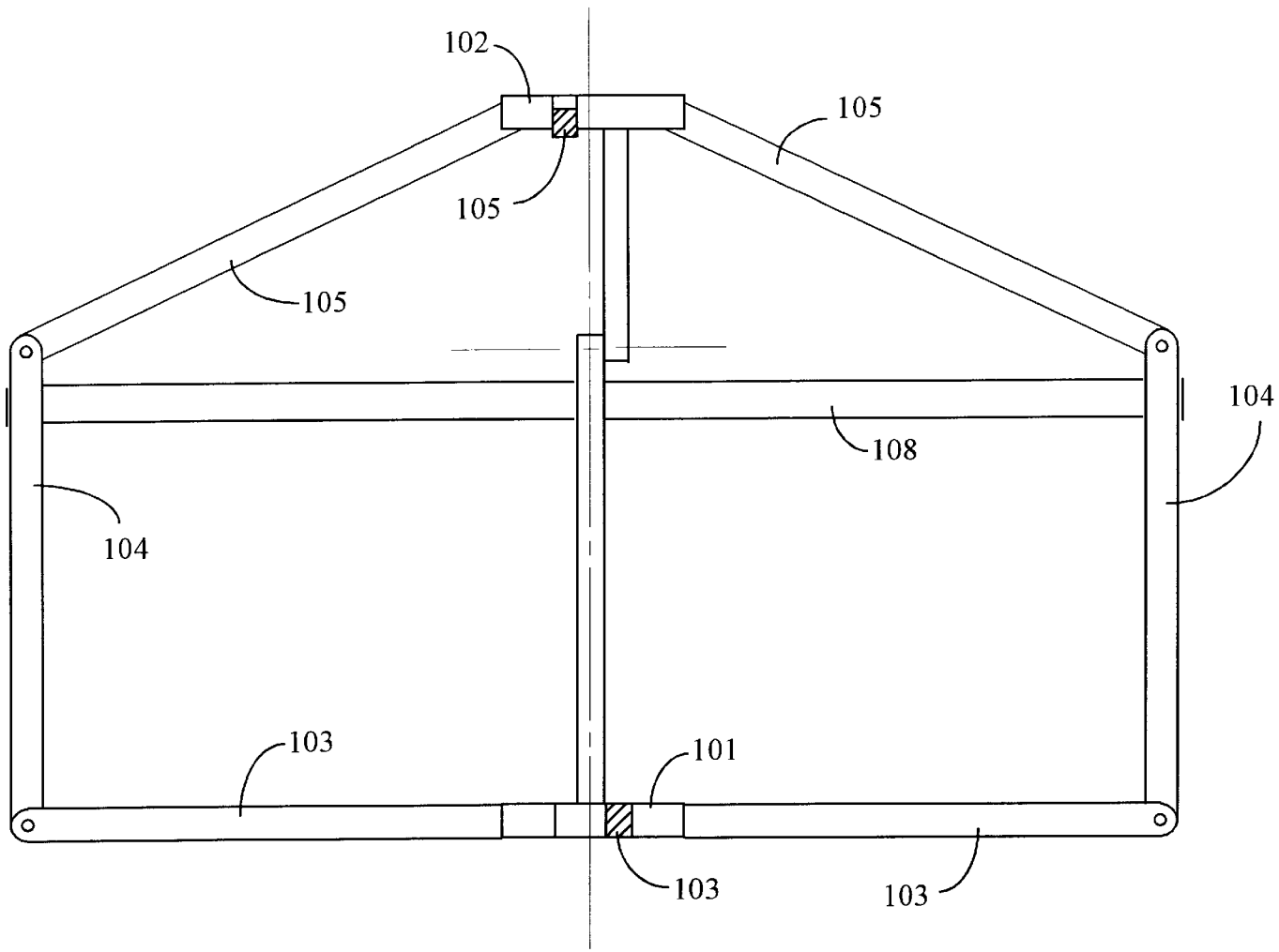
FIG. 3 is a section view of the framework of FIGS. 1 and 2 along section line 3—3 of FIG. 2.
Figure 4:
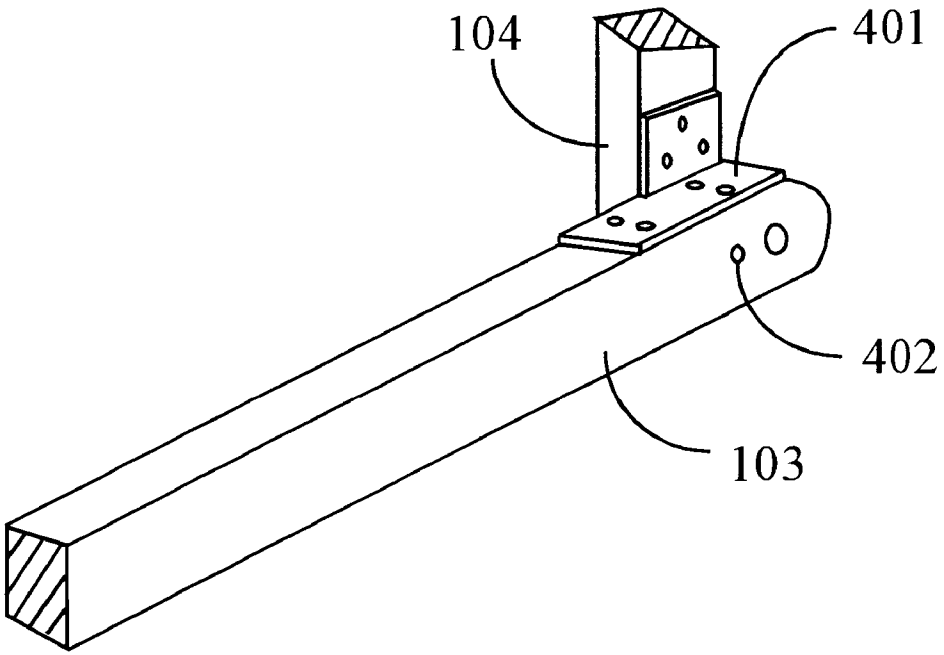
FIG. 4 is a perspective view of one track and mast with a bracket imposed.

FIG. 3 is a section view of the framework of FIGS. 1 and 2 along section line 3—3 of FIG. 2 in the direction of the arrows. It should be clear at this point to the skilled artisan that there may be as few as three tracks, masts, and rafters with the two hubs to form a framework for a structure, and that there may theoretically be any larger number of each, with a practical upper limit in terms of space and complexity. For example, a framework with ten of each of tracks, masts, and rafters will provide for a ten-sided structure, but at some point the structure becomes somewhat unwieldy. The four-sided structure shown, however, has some advantages for description. It will become clear below that there are some good reasons for more than four sides, such as five to eight sides, for example.

As seen in FIG. 3, with tracks 103 horizontal, masts 104 vertical, and rafters 105 at an angle to horizontal or vertical and supporting hub 102 at a higher position than the junctions between the masts and the rafters, the shape defined is quite similar to the well-known shape of a house or shed, having vertical walls and a sloping roof line. Cinch 108 provides constraint dis-allowing independent movement of masts 104 to other than a vertical aspect with the influence of the downward urging of the weight of rafters 105 and hub 102.

The skilled artisan, by considering FIG. 3, will see that stability of the structure will be enhanced by a wider cinch 108, and by joints between the rafters, masts, and tracks having close tolerance. In some embodiments there will be brackets for enhancing stability at joints, such as bracket 401 shown in FIG. 4. Bracket 401 in this example has holes for conventional screw-type fasteners, but there are a variety of ways such brackets may be implemented, such as with clamping elements for quick changing. Another way stability may be enhanced is by providing locking holes 402 through one member and into another at the position desired, so a pin may be inserted when the structure is erected, preventing further rotation of a joint. There are many such possibilities.

FIGS. 3, 5, 6, 7 and 8 are views along the aspect of FIG. 3 at a sequence of folded conditions of the framework, illustrating a process of folding the framework into a much smaller aspect for storage and/or transport.

Figure 5:
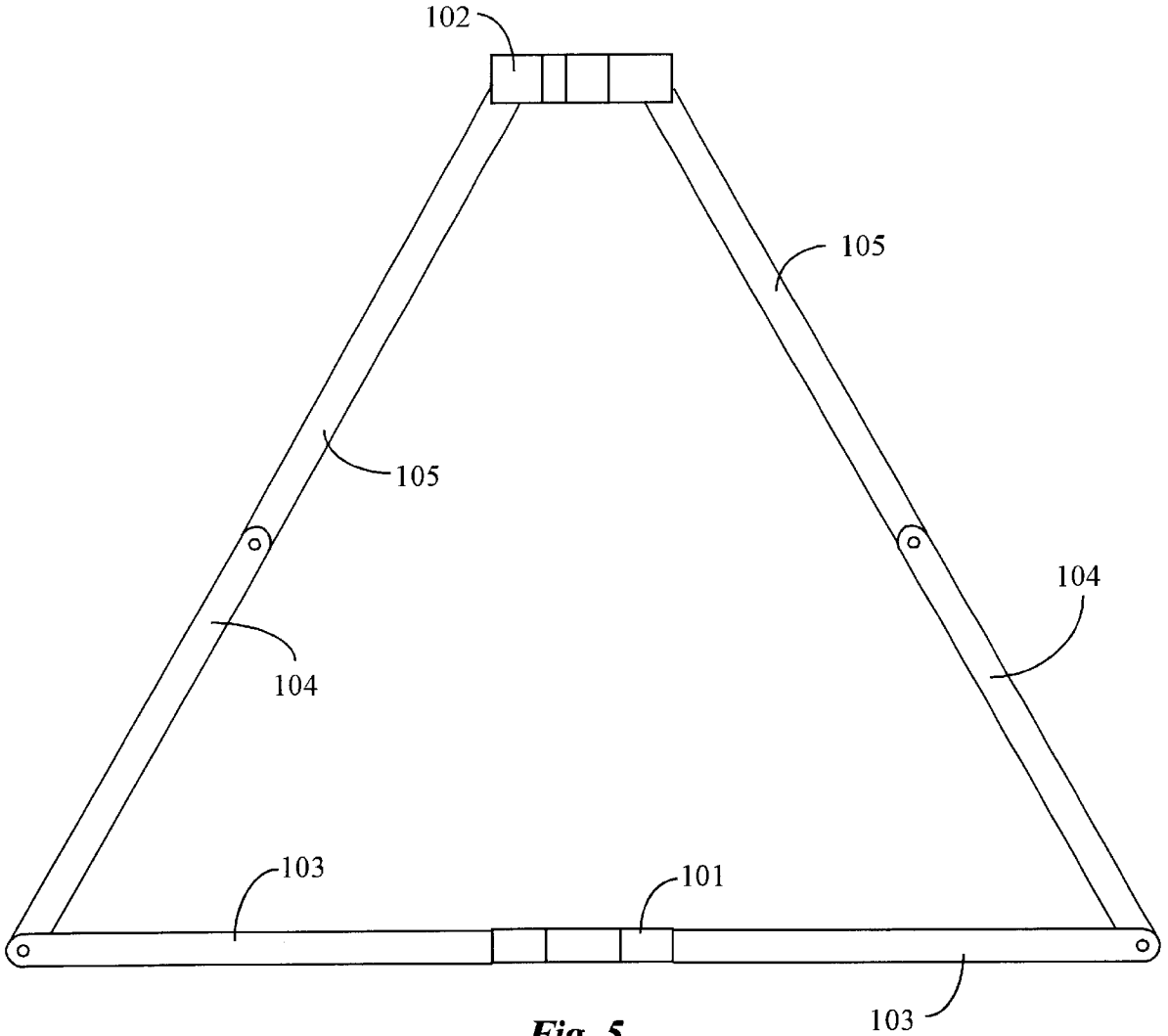
FIG. 5 is a view along the aspect of FIG. 3 at a point where the framework has been folded to a first condition.

FIG. 5 shows a first step wherein cinch 108 has been removed, and hub 102 is raised to a point where rafters 105 and masts 104 are colinear, while tracks 103 remain horizontal. For the sake of simplicity and clarity, the elements before and behind hubs 101 and, 102 are not shown in this and following figures, leaving the opposing elements to the right and left to illustrate the principles. The action of the opposing elements before and behind is the same as the elements illustrated.

Figure 6:
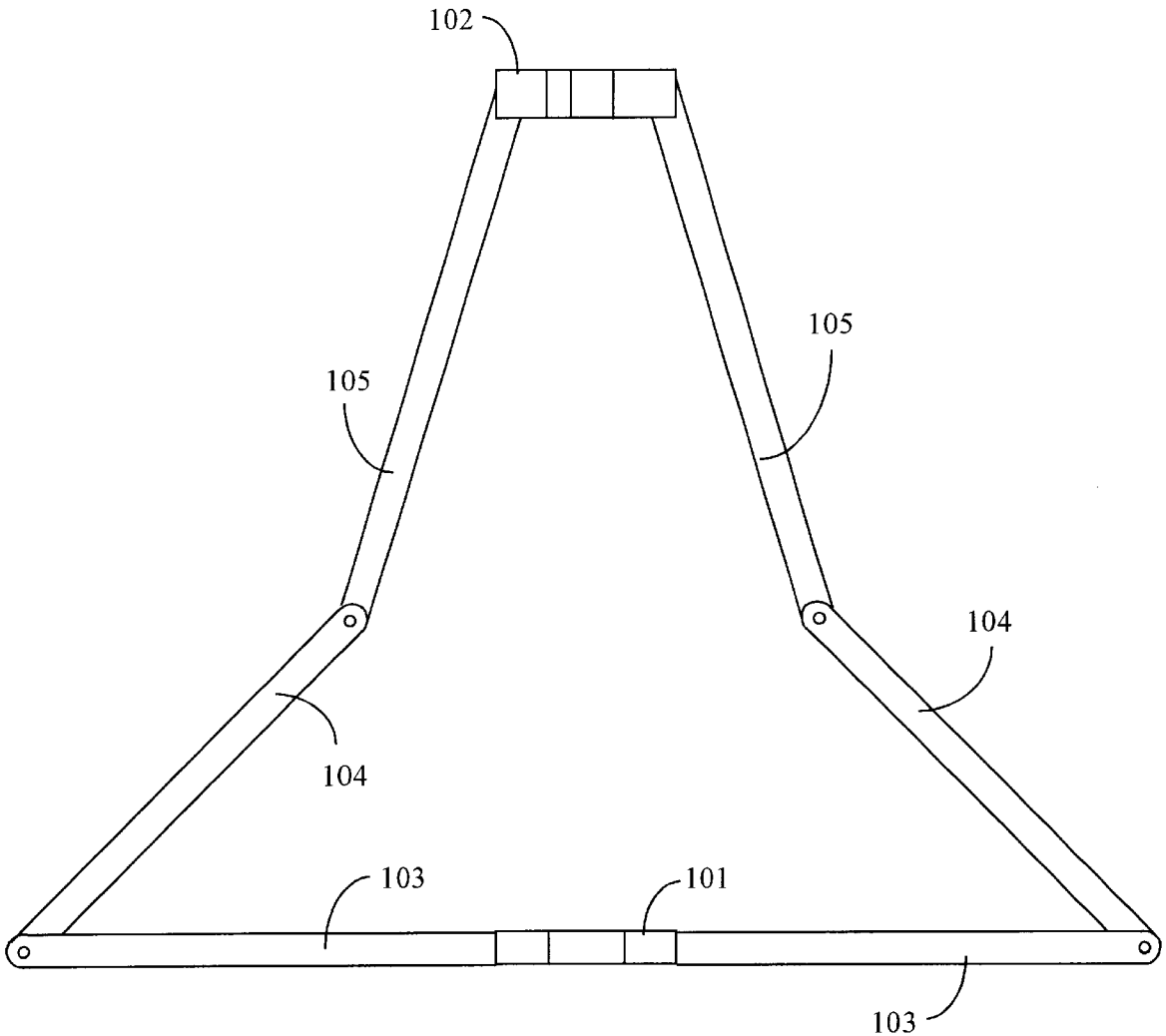
FIG. 6 is a view along the aspect of FIGS. 3 and 4 showing the framework folded to a second condition.

FIG. 6 illustrates a next step wherein the joints between rafters and masts are further rotated such that the masts may be further folded toward hub 101, drawing the rafters along.

Figure 7:
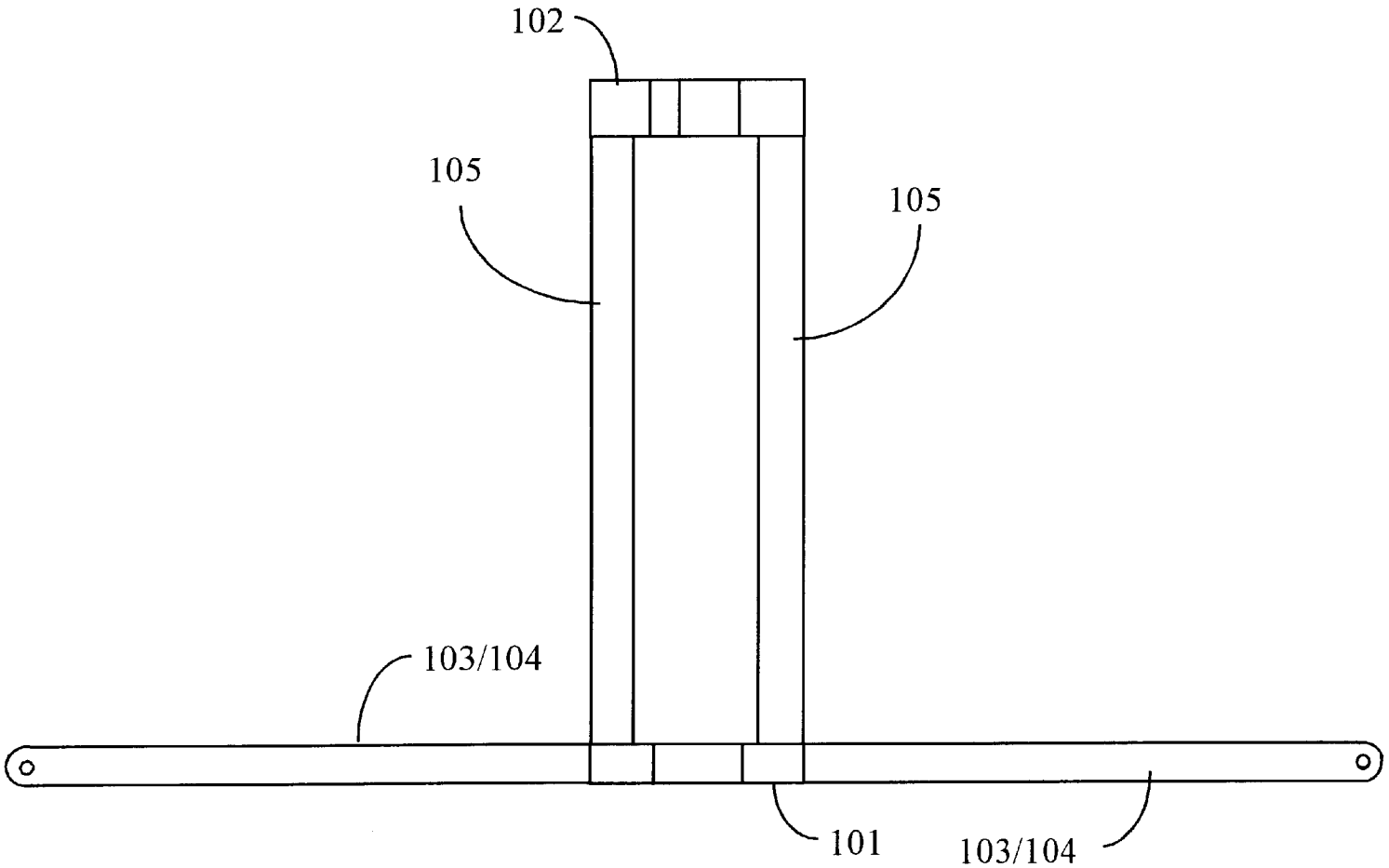
FIG. 7 is a view along the aspect of FIGS. 3 and 4 and 5 showing the framework folded to a third condition.

FIG. 7 illustrates a next step wherein masts 104 are folded further down to be horizontal adjacent to tracks 103 to which each is pivotally connected. In this particular embodiments the tracks and the masts are all of the same length, so the ends of masts 104 which are pivotally connected to rafters 105 tuck into openings 107 (see FIG. 1) immediately adjacent to tracks 103. This condition of folding causes rafters 105 to become vertically oriented and entirely within the bounds of the two hubs 101 and 102.

FIG. 8 illustrates a final folding step wherein the side-by-side tracks and masts are folded upward to be adjacent to the vertical rafters 105 to which each set is connected, and all elements are, at this point, entirely within a boundary defined by the footprint of the hubs and the length of the rafters.

At this point it will be clear to the skilled artisan that the folded framework occupies a considerably reduced volume compared to the fully-deployed framework, and the folded framework is much more easily portable and storable. The folded framework may be bound around the outside by cinches or straps or may be inserted into a carrier bag or the like for transport and storage. Other components, such as brackets, cinches and the like may be stored in the same package or bag as the folded framework, to be easily accessible for re-erection.

Referring now back to FIG. 1, which shows a framework deployed to be a frame for a structure, it is clear that the deployed framework may be deployed by reversing the steps of folding, starting from the folded package of FIG. 8. In some embodiments, to provide a usable structure one must add such as floor and side panels, or what has previously been termed a skin to the framework However, in some other embodiments, flexible membranes constituting the eventual ceiling, walls and floors are provided in the folded unit. In these embodiments, a ready-to-use and in some instances airtight structure is available as soon as it is erected. The sagging and the trampoline effect of the flexible 3floor can be reduced and dampened in these flexible floor embodiments by stays or other stiffeners inserted into the pockets in the canvass or webbing comprising the floor.

FIG. 9 shows two tracks 103 for a framework according to an embodiment of the present invention that has a hexagonal footprint, and therefore six equally-spaced tracks 103. Only two of the six tracks are shown in FIG. 9, deployed at an included angle of sixty degrees, which is full deployment for the hexagonal configuration. Portions of two masts 104 are shown as well, along with a floor panel 901. Panel 901 has a generally triangular footprint, matching in general each of six identical portions of a base formed by the six deployed horizontal tracks.

In this particular example panel 901 is supported by about one-half of the width of each track, and can be affixed to the tracks in any number of ways, such as by conventional fasteners like screws, or may have, in some embodiments, engaging elements, such as pins, for engaging the tracks. Also the panel is shown with broken-out sections to be able to show more of the structure beneath the panel. Such panels in various different embodiments may be shaped around the masts, and may extend to the center of the hub 101, to make a complete floor in the deployed framework.

In various embodiments such floor panels may be provided in larger or smaller pieces than those shown, and may be engageable and fastenable to the extended framework in a broad variety of ways.

FIG. 10 is a perspective view of an extended framework as seen in FIG. 1, including a skin 1001 added over the framework to provide an enclosed structure. In one embodiment skin 1001 is a one-piece skin formed of a conformable material such as fabric, canvas, for example, which may be folded or rolled when not in use, and unfolded or unrolled and added over the deployed framework. Such a skin may be affixed to the framework in any number of ways, or not affixed at all, depending on necessity and use. As noted previously, in many embodiments skins may be folded with framework itself, and this is even true for flexible floor skins. The more common stiff sectional floor panels 901 are seen through the doorway, and would stack rather than fold when the framework is refolded In the example shown there is a door having two opposite flaps 1004, such as may be provided for a tent. In this case the door flaps have zipper closures as is known in the art. In other embodiments the door may be rigid panels on hinges, with various types of fasteners and retainers.

In some cases rigid panels 1001, 1003 and 1006 may be separately affixed to the framework to make a more rigid structure than with the fabric skin. There are many materials, such as wood and plastic, suitable for such panels. In some cases similar panels may be affixed to the inside of the deployed framework to make a double-wall construction, and in some cases insulating material may be added between the walls. There are many possibilities. In one embodiment a pocket 1005 is provided in the skin around the lower and outer periphery of the skin. Dry material like sand, soil or stones may be added to this pocket to provide ballast to make the structure heavier and more secure against weather phenomena. In some cases the pocket may be liquid-tight, and may be filled with water or other liquid for the same purpose.

In another embodiment of the invention the folding framework is provided additionally with slides to allow folding and storage in different ways. FIG. 11 is a perspective view of a framework 1101 in an alternative embodiment of the present invention. Framework 1101 has all of the essential parts of the framework of FIG. 1, and the parts have been similarly numbered as 1101, 1102, etc., to correspond the parts shown in FIG. 1 and described above.

An important difference between the framework of FIG. 1 and that of FIG. 11 is that tracks 1103 each are grooved along substantially the entire length. In this embodiment grooves 1109 pass completely through tracks 1103 so that the pivot shown as point 1110 at the lower end of mast 1104 and the outer end of track 1103, may slide along groove 1109 in track 1103 from one position near hub 1101 to position 11 10 shown, where the mast attains a vertical position if the track is horizontal.

FIG. 12 is a plan view of framework 1110, similar to FIG. 2. As the difference between the apparatus of FIG. 1 and the apparatus of FIG. 11 is principally the presence of slides in the tracks, the plan views of the two apparatuses are essentially the same.

FIG. 13 is a section view of the framework of FIG. 12 taken along the section line 13—13 of FIG. 12. Again, since the two apparatuses are very much alike, these section views are very similar, except for the presence of the slide groove in elements 103 of the apparatus of FIG. 13.

FIG. 14 illustrates a first step in folding the framework of FIG. 12 for storage or transport. It should be emphasized that in the folding operation, this is not a point at which the folding would stop for a next step to begin. Normally folding would proceed straight though the point shown. The purpose is to illustrate how the folding process proceeds for the apparatus shown. As can be seen in the figure, the pivot elements of masts 1104, having been disengaged from any clamps, brackets, and the like that might be used to keep the lower end of the masts secure at the outer ends of tracks 1103, are moved inwardly along grooves 1109 in tracks 1103, toward lower hub 1101. As this movement takes place, the upper assembly comprising rafters 1105 and upper hub 1102 is lowered. It will be clear to the skilled artisan that it not necessary that all four (two are shown) of the masts be moved and lowered at the same time, but the apparatus can be restrained to do so.

FIG. 15 illustrates another step in folding the framework of FIG. 12 for storage or transport. At this point the lower ends of the masts 104 have been moved along tracks 103 all the way to hub 1101, and now tracks 103 and masts 104 are adjacent and horizontal. As a result, the upper roof structure comprising the rafters and the upper hub retain the deployed shape and form, but this portion of the structure is now at ground line. This has some definite advantages, particularly in the opposite, or deployment, process. For example, having the roof structure at ground level allows roof panels or other skin forms to be easily added before the roof is raised to its final position.

There is a choice to be made at this juncture. The upper hub can be raised now, keeping the masts and tracks adjacent and aligned, and allowing the mechanism to pivot at lower hub 1101, at the rafter/mast pivot, and at the upper hub 1102. If this action is taken to completion and final package has the footprint of the hubs and a length equal to the sum of the lengths of a rafter and a mast or tracks, assuming that the masts and tracks are of equal length. It is not necessary that masts and tracks be of equal length, however. The masts might be shorter than the tracks. But the shape shown in FIG. 15 cannot be attained if the masts are longer than the tracks.

The other choice, beginning at the point shown in FIG. 15 is to raise the lower hub 1101, still keeping the masts and tracks adjacent, until the rafters 1105 are vertical and adjacent the tracks and masts, which will also then be vertical. The two hubs are then separated by a distance equal to the difference in length between a rafter and a mast or track (assuming the two are equal). If the masts are shorter the separation is the difference between the lengths of a rafter and a track. FIG. 16 illustrates this condition, which package has the footprint of the hubs and the height (or length, if you please), of the rafter. This choice produces a final package for storage of exactly the size of the package formed by folding the apparatus of FIG. 1, except that the package of FIG. 1 has a hub at each end, which may have some advantage in transport and storage. So the trade-off is to introduce the further complexity of the grooved tracks in return for the roof structure being at ground level at one point, allowing skins or panels to be added before the roof is raised.

It is instructive at this point to provide some dimensional examples. A folding structure framework might be made, for example, according to the embodiment of FIG. 1, with two-by-four material for tracks, masts, and rafters. The hubs in this case can take any one of many forms, but assuming the form and round shape shown in the embodiments illustrated, the diameter of the hubs is dictated partly by the cross-section of the linear elements (tracks, masts, and rafters). A two-by four is well-known to be 1¾ inches 3½ inches. The hub, then, has to accommodate, in the case of a hexagonal embodiment, the cross-sections of eighteen elements. Three elements side-by-side makes 5¼ inches. The circumference of the hub must be greater than six times this dimension, or 31½ inches. Assume about 36 inches. The diameter of the hub will be, then, about 12 inches for a hexagonal embodiment using 2×4 members.

Following this example, assume tracks and masts of equal length at 6 feet, each, and a roof pitch of 30 degrees is desirable. The rafter length for a roof pitch of 30 degrees calculates to about 7½ feet. The resulting structure, fully deployed (see FIG. 1 or FIG. 11) will be about 13 feet across from flat side to flat side, will be 6 feet high at the eaves, that is at the masts, and will have a height of about 10.5 feet at the center. The framework for this structure will fold into a package 7.5 feet long and 1 foot in diameter for transport and storage.

There are many variations in alternative embodiments that may be made by altering details of the embodiments thus far described. For example, in many embodiments it is desirable that lower hub 1101 have additional elements to secure the tracks in horizontal position once deployed. FIG. 17 illustrates a portion of a lower hub 1101 comprising a lower flange 1701 and restraining clamps 1702 (one only shown in the figure), implemented such that, with the tracks 1103 deployed horizontally, clamps 1702 may be imposed over the tracks and secured to hold the tracks against the flange in a horizontal deployment. The inventor believes that one only of the clamps and tracks need be shown, as these will be repeated at generally equally-spaced intervals for frameworks with a plurality of tracks.

In the embodiment shown in FIG. 17 a clamp consists of a cross piece and two slotted screws. It will be evident to the skilled artisan that clamps and other restraints for holding tracks to hubs when the tracks are deployed may be implemented in a broad variety of ways. In some cases a simple u-bolt may be used. In others the tracks may be undercut for the clamp so there will be no protrusion of the clamps above the track tops to interfere with application of floor panels. In yet other cases hinged clamps may be used. There are many possibilities. In some cases a second flange may be employed to overlie the hub after clamps are deployed, and fasteners may be passed through matching holes in the two flanges to draw the flanges together to clamp the tracks between the hubs.

Referring now back to FIG. 1 and FIG. 11, it is noted that the tracks, hubs and rafters are shown as pivoted to one another generally with simple pin joints. In some alternative embodiments, however, more functional joints are employed providing sliding relationships as well as pivoting. FIG. 18, for example, illustrates a connection between a track 1103 and a mast 1104 through a separate compound joint element 1801 that provides for pivoting between the track and the mast, as well as sliding adjustment along both the track and the mast.

Joint element 1801 in FIG. 18 comprises two connected cylinders 1802 and 1803 that are connected by a pivotal joint along an axis centerline (CL) 1805. This pivotal joining, with a round track 1103 inserted through cylinder 1803 and a round mast 1104 inserted through cylinder 1802, provides the same pivotal freedom as provided in the purely pivotal joints shown between mast and track elements in FIG. 1. The mast and track may be pivoted with their long axes in parallel planes.

In addition to the pivotal aspect, each of cylinders 1802 and 1803 has a set screw 1804 in a threaded hole, such that each cylinder may be translated along the engaged mast or track, and fixed in a desired position. The sliding of cylinder 1803 along a track provides for the movement of a pivot point described for the embodiment shown in FIG. 11. The sliding of the mast through cylinder 1802 allows mast height to be adjusted, and therefore the height of a structure based on a framework having these features to be adjusted as well.

It will be apparent to the skilled artisan that the openings through a compound joint such as that shown in FIG. 18 need not be round. Square openings, and other shapes, will accommodate tracks and masts of different shapes. The joint allowing sliding of track and mast elements nay be implemented in other ways as well, and, in some cases, only one of the sliding features may be implemented, either for the track or the mast.

In some embodiments of the invention joints such as those described with reference to FIG. 18 may be used at the juncture between masts and rafters as well. This feature provides for some interesting features further described below.

FIG. 19 shows a structure in cross section similar to the structure of FIG. 1, but having compound joints 1801 between each of the tracks and masts, and between each of the masts and rafters. The arrangement in this embodiment provides some very useful and interesting features for structures based on the framework. For example, masts and/or rafters of extra length, or capable of telescopic extension and contraction may be used. Then structural effects that were not before available may be provided in embodiments of the invention.

FIG. 20 shows the cross-section of FIG. 19 in which the masts have been adjusted in joints 1801 at the junctures with the tracks to provide for extended legs, or stilts, 2001. By this feature, structures can be provided that are useful in swampy or flooding situations, to position a living or storage structure, for example, above a danger level for flooding. By the same feature, with skins extended below the floor level, a lower enclosure is provided for such as a cellar, or basement. With the floor of the structure at the higher level, one may store useful material and equipment in the lower enclosure. In some embodiments a third hub and a second set of tracks may be assembled to the framework with floor panels added, so the lower structure may also have a floor above ground level. Similarly, further added structures as described above may provide for any practical multiple of floors and rooms, or enclosures, according to need and purpose.

As also seen in FIG. 20, extension of rafters 105 through joints 1801 may provide for extended eaves, allowing for roof panels to extend well beyond the walls supported by masts. This feature, shown as 2002 in FIG. 20, provides advantages such as better rain runoff, forcing water to run off at a further distance from the wall lines, and also may be used in some cases for further outside shelter, much like a porch on a more conventional structure.

The ability to slide masts through joints 1801 between the rafters and the masts provides for yet another salient feature for structures supported by frameworks according to this embodiment of the invention. FIG. 21 shows a framework for a structure similar to that of FIGS. 19 and 20, but in this case the roof portion of the structure, formed by the rafters and upper hub 102, with any covering skin, is lowered to nearly the level of the tracks that provide for a floor. This is a useful feature for structures that may be subjected to severe weather conditions, to provide a lower and less vulnerable profile to wind for example.

The ability to slide rafters in joints 1801 at the points where the rafters and the masts intersect provides yet another useful feature for structures with frameworks according to embodiments of the present invention. FIG. 22 shows a framework similar to that of FIG. 19, wherein the rafters have been slid outward until the rafters are horizontal, and then slid back inward while lowering upper hub 102, providing for an inverted roof (assuming skin in place). In such a structure, with several sides to the polygon, the inverted roof provides a funnel for rainwater, which may be guided into a cistern or directed into containers through an opening in the hub. In suitable climactic conditions, this structure may also at certain times of day (morning and evening, for example), collect condensate to provide drinking water, even in the absence of precipitation. Structures of this sort for collecting water for whatever purpose need only the inverted roof skin, and not necessarily wall skins, and may be built in various sizes to suit different purposes and applications. It will be clear as well, that a structure according to embodiments of the invention may, by suitable amendment, using the features provided, be dedicated to many different purposes.

It will be apparent to the skilled artisan that there are many forms that an adjustable joint, such as joints 1801, may take. There may be, in some cases, a double rafter and a single mast, a double mast and a single rafter, or two of each, for example. The joints, providing for translatable adjustment of one or both of rafters and masts, as well as for rotational adjustment of rafters to masts, may take any one of many physical forms providing the essential features. Similarly, hubs and tracks can take many forms as well to provide the features described herein.

In some embodiments frameworks according to the invention are relatively small and light, and may be deployed and folded relatively easily by one or two persons manually. In some cases with larger and relatively heavier frameworks, more human help will be needed. In some cases mechanisms are provided for deployment, and for aid in subsequent folding, such as cord or cable and pulley systems, which may also provide for a mechanical advantage. Consider, for example, the framework of FIG. 11, wherein the masts at the lower ends are made to translate along the tracks to erect the masts to a vertical orientation.

FIG. 23 is a plan view of a portion of the framework of FIG. 11. The rafters and upper hub have been removed to better illustrate a cord and pulley system that may be used to erect masts for the framework of FIG. 11. In FIG. 23, only the lower hub and side-by-side tracks and rafters, both horizontal, are shown. In this example a pulley or post 2301 is implemented at the outer end of each track, and another pulley or post 2302 is implemented at the end of each mast that is adjacent the lower hub 1101 before the masts are raised. A cord, cable or equivalent 2303 is passed from a winding drum 2304 to go around pulley 2301 on a first of the tracks, then to and around pulley 2302 on the adjacent mast near the inner hub, then back to pulley 2301 and around in the same direction as before. The cord or cable then passes to the next track end, and the winding is repeated for that track/mast combination; and so on until the last mast and track; then the cord or cable is passed back to the drum 2304 and anchored there. By turning drum 2304 clockwise the loop of cord made around the pulleys becomes smaller, and as the loop gets smaller, the mast ends near the lower hub are drawn outward, and the masts are erected, raising the rafters and upper hub, until the framework is fully deployed. At that point, the cord can be removed, or stowed in some manner.

The skilled artisan will recognize that there are a broad variety of ways that such pulley systems may be implemented to aid in the erection and deployment of frameworks in embodiments of the present invention. The system illustrated is merely exemplary.

Another feature of frameworks in embodiments of the invention involves the nature of the hubs. In some embodiments telescoping hubs may be provided, or a central spine may be provided through, for example, an opening in the lower hub, such that an erected, deployed framework will have a post on the centerline, extending part way between the hubs, or all the way between the hubs.

FIG. 24 is an illustration of a framework much like that of FIG. 1, showing in addition a telescoping center post 2401 affixed to lower hub 101, and having an overall collapsed height, H, less than the overall length of one of the rafters 105. As it is the height of a rafter that determines the height of the collapsed, folded package of the framework, center post 2401 will not, if it is not too great in diameter, interfere in any way with the folding of the framework for transport or storage.

Center post 2401 in this embodiment has an outer portion 2402, affixed to lower hub 101, and an extending inner portion 2403, which is shown as extended to the height of upper hub 102. Extended as shown and affixed in the extended position, which may be done in any one of several ways, such as by a standard fastener, the center post can support and strengthen the framework and any subsequent structure based on the framework.

It will be apparent, given the teachings above, that a center post may also be used with the framework in embodiments based on FIG. 11, and a framework with slidable and translating joints, as also taught above. Further, a center post may also be extendable below lower hub 101 for various purposes. Referring to FIG. 20, for example, in a situation wherein masts or mast extensions may be used to raise a floor on tracks 103 above ground level, or in a case wherein more than one lower hub and tracks may be used to create separate stories in a single structure, a downward-extending center post may be used to provide additional center support for the resulting structure.

There is little limitation to uses for structures based on a framework as taught above in various embodiments of the invention. Structures may be contemplated for housing, for storage, for camping out, for classrooms, for hot houses, for water collection, for deploying solar panels, and much, much more. Even water-borne structures may be provided, such as by affixing floats below a base formed by tracks and a lower hub. FIG. 25, for example, shows a unit such as shown in FIG. 10, but having added float structures 2501 affixed beneath the structure. In FIG. 25 the floats 2501 are shown detached, and below the structure, with arrows indicating that are to be placed directly under the structure. The floats 2501 could be such as inner-tubes, or other bladder-like components, or could take other shapes, being filled with air or other lightweight material. There could be one centrally-located float, floats at corners, or in any other number and stable arrangement to provide a floating structure.

Such a floating structure might find employment as a barge, a pleasure craft, a fishing platform, and so forth. Such structures could be powered in any conventional way, such as by outboard or inboard engines, by oars, and by poling as done with some rafts, for example. Such floating structures can also be employed as housing units to take advantage of waterways and reservoirs and the like as real estate for low-cost housing.

In another aspect of the present invention structures based upon modular frameworks as taught in various embodiments of the invention herein may be joined in a wide variety of ways to provide composite and multilevel structures for many interesting purposes. FIG. 26 is a plan view showing just the plan view outlines of four octagonal structures 2601–2604, joined in a rather simple example.

The octagonal structures of FIG. 26 are, in this example, of the same physical size and structure, although this is a convenience, not a limitation in joining. In this case one of four structures is used as a central unit, and the other three are joined to the central unit at three sides of the eight sides of the central unit, leaving an open side between each side joined. In this arrangement the central unit has one outside door 2602, and within the composite structure at each of the joined sides, an inner door 2603 is provided. Windows of various sorts may be provided in the remaining unjoined sides of the four structures (or not). There may also be other outside doors in one or another of the structures.

There are various ways that joining may be physically accomplished. Because the sides and structures are basically indentical, in the joining shown there will be, at each joining interface, adjacent masts in each of the side-by-side structures. Conventional fasteners, such as bolts and nuts, or clamping mechanisms, may be used to fasten mast-to-mast between any two structures. Doorways and/or windows may be pre-planned, or accomplished after the fact. Of course additional units may be added in a variety of symmetrical and non-symmetrical ways.

In an arrangement as shown in FIG. 26, and other similar arrangements, each separate unit is a collapsible framework, as taught above, and may be separately and independently folded and stored. In one example, such a composite structure, based on independent modules, may be used for a camping unit (portable), or as a housing unit with several extra rooms, such as bedroom and utility rooms, around a central hall. There are many possibilities.

There are many other possibilities for joining than the rather simple example shown in FIG. 26. It is not necessary, for example, that the different units be identical. Units of different sizes and shapes can be joined as well. For example, a central unit may have eight sides as shown in FIG. 26, but peripheral units could have fewer or more sides than eight, with the sides still being the same in size and shape. Even if sides are not the same size and shape, they may be joined.

FIG. 27 illustrates an arrangement combining side-to-side joining with a novel use of central posts extending below the lower hubs of joined units. In this example two unit structures 2702 are joined at one face and integrated with other elements to provide a boat unit 2701. Posts 2703 are downward-extending center posts in each of units 2702 as described above. A structural keel 2704 is joined between the lower ends of each of posts 2703. Framing elements are added between the keel and the points of each unit 2702 where tracks and masts meet; that is, at the lower ends of masts as shown. The resulting planes are then covered with a suitable skin, such as rigid panels with joints sealed, or with a fabric-type conformal skin. The result is a hull for the resulting boat structure. FIG. 28 is a front (or rear) view of unit 2701 from the perspective of the arrow labeled "FIG. 28" in FIG. 27, which looks along the length of keel 2704.

It will be evident to those skilled in the art that addition of one or more hub and track units coaxial with the one shown in FIG. 28 can produce multi-decked craft, but much more remarkably can be employed to produce any number of more favorable hull shapes beneath the waterline. Indeed, to the extent the track lengths and/or distance between the stacked hubs is/are variable, an extremely interesting variable and "tunable-shaped" hull results. One may make, for example, out of a pentagonal three-hub unit, a flat bottomed or deep hulled keeled craft, or anything in between, and thus enhance hull shape effectively without limit in order to, for example, meet changing weather, conditions, propulsion modes, or ways of using the craft or to alter the its primary or ultimate roll stability characteristics. It will be evident to those skilled in the art that by varying the spatial relationship and/or length or number of stacked platforms, there is no limit to the number of different shapes that can be achieved.

Another embodiment of an infinitely tunable shaped hull is provided simply by extending rods or suchlike protruding elements, which in some embodiments are masts, downward from or through the tracks above, at the position above which an angular bend in the hull is desired. Variant submerged hull shapes can be achieved by this alternative method, which does not require multiple stacked platforms so long as the stacked platforms decrease progressively from top to bottom.

Once it is pointed out, those skilled in the art will appreciate the fact that very optimal hull shapes at the beam can be produced using the frameworks herein described when they are joined, laterally. In one embodiment there may be an equilateral hexagonal framework with vertices of angles of $3\pi/5$, $3\pi/5$, $4\pi/5$, $3\pi/5$, $3\pi/5$, $4\pi/5$, with the addition of an equilateral framework at the bow, resulting in a rather classical nautical shape when seen from above. This shape also provides for promising docking and packing characteristics easily appreciated by those in skilled in the naval arts.

A different shape can be produced by two pentagonal framed units combined with two rhomb framed units (which is two say, two parallelogram with angles $\pi/5$, $4\pi/5$, $\pi/5$, and $4\pi/5$. As in the previous example, the combined craft enjoys unusually favorable docking and packing characteristics. Moreover, the rhomb by itself exhibits a familiar and recognizable hull shape: that of the single kayak. Those skilled in the art will readily appreciate the potential for break-apart modular hulls made possible by the disjoining of such modular framed units, the modular framed components of which can function as smaller hulls, docks, or barges, to give only a few examples.

Returning now to the aspects of joining individual modular unit structures having frameworks according to embodiments of the present invention, it is also possible, and in many cases convenient, to stagger units in joining, and to create multiple levels of joined units. One purpose for such joining of units is to create multi-level housing. FIG. 29 illustrates one way staggering and multi-level joining may be done.

In FIG. 29 line 2903 represents a ground line, and two units 2901 are shown resting on the ground, and spaced apart to an extent that another unit 2901 may be stacked on the two at ground level by aligning the masts of the upper unit with those of the two lower units. Joining in this case can be done in a number of different ways. In this example, sleeve units 2902 are used to join the masts of the separate units. In this example the units are four-sided, so two of the masts of each unit are hidden behind the foremost masts. This is not a limitation, however, as units of other geometry may be used as well, and there is no requirement that the units be identical.

As a further example of the sort of stacking described with reference to FIG. 29, FIG. 30 is a plan view of an arrangement using octagonal units. In this arrangement there are nine units, but there could be many more. The five units marked "a" are at ground level, and the four units marked "b" are at a second-storey level with their appropriate masts joined to the masts of the lower units in the fashion described above with reference to FIG. 29, or an equivalent. It will be apparent to the skilled artisan that many other arrangements are possible, and that there may also be further levels provided by stacking units at a higher level on the second level, and so on. There are many possibilities based on this sort of stacking of units based on embodiments of the invention.

FIG. 31 illustrates yet another way that modular units may be staggered and stacked. In FIG. 31, one unit 3101 is joined to another unit 3102 by overlapping at least a portion of the "floor" structure of each unit, in this particular example, in the region indicated by element number 3103. This overlapping and joining will typically be accomplished in erection and before skins are added, although this is not strictly necessary. In some cases the overlapping areas can be joined by conventional fasteners, such as bolts and nuts. In some cases, one or both of the joining units may have a double set of tracks, supporting two floor structures, with at least one set joined to masts by translating elements, such that a floor of one unit may be trapped between two floors, one at least translatable, of the other unit. This overlapping method, with suitable translating elements, offers a broad variety of geometries in joining.

In the joining and staggering teachings above it is necessary to emphasize that, although individual modules, or Monads, are typically unitary for erection into deployed frameworks, or for collapsing into minimum-space and volume units for transport or storage, that some disassembly and/or re-assembly may well be done to accomplish specific goals.

As an example of erection, consider the watercraft illustrated by FIGS. 27 and 28, for example, there may be two self-contained framework units 2702, separately collapsed for storage and transport. The keel 2704 and other structural elements may be disassembled and stored separately, such as skins for both units and for the hull. Erection into the watercraft 2701 would proceed roughly by unfolding the frameworks of the two units 2702, then joining the two units at one side face. Then the downwardly extendible center posts 2703 may be deployed, and the keel affixed to the lower extremities of the two center posts. After affixing the keel framework elements are added from each end of the keel to the underside of certain forward-facing and rearward-facing masts, to provide a framework for the hull. These elements may be, for example, cables with tightening mechanisms.

After the hull framework is accomplished, one may affix skins to both the hull and the upper units 2702, to complete the watercraft envelope. The skins can be any of, or a combination of, a broad variety of elements, such as fabric or rigid panels. One may also add propulsion elements, such as oars, engines, or sails.

The same general principles are true for other combination structures generally bases on foldable monad frames as taught herein. For example, one might have a reason for removing, after erection, just the rafter and roof elements of all, or a select few of the distinct units that might be joined to make a composite structure. For example, the lower hubs, tracks and floor often might well be stored, handled and used as single assemblage for countless purposes subsumed under the general category of "platforms"; while the top sections comprising upper hub, rafters and masts well might likewise be folded, stored, handled and used as separate assemblages, broadly in the manner of a tent, carport or canopy, to name only a few examples.

Generalized Material

The disclosure above is illustrated by certain figures, and is specific to the principles and features of the present invention. The disclosure that follows this point is more general in nature, and illustrates more broadly many of the motivations for and principles of the present invention, and provides broad disclosure of many and varied uses for the embodiments of the invention taught herein. This is not to say that there are no specific embodiments of the invention explained wholly in the following material.

This paragraph is meant as a relative summary of a Modular Or Non-Attached Autonomous Device (MONAD), as illustrated above in many various embodiments of the invention, functioning either as a stand-alone unit or aggregated into compounds or complexes. The MONAD in general is the fundamental element of a hyper-multipurpose over-system (named 4-PASS by the inventor) of about 16 systems adapted to emergency, temporary or semi-permanent use in virtually all terrains, including wet and dry land, water, & ice, each system being quite broad in its own right. The MONAD is comprised in most cases of equilateral polygonal platform-based foldable, highly compressible framed clamping MONAD structures, deriving wide versatility from radical symmetry, all-directional interlinking, maximal extensibility and scalability. These advantages are obtained at least in part through applying principles of tiling, information theory and class inheritance, such that cardinal qualities of the MONAD, for instance rapidity of set-up, are passed on to compounds and complexes formed of MONADs, making possible, for example, the deployment within minutes of a multi-chambered complex of raised, hard-decked, completely enclosed, interconnecting structures and compounds, each chamber with its independently filtered air supply, even on a very large scale, which could save countless lives and alleviate untold suffering in natural emergencies, major accidents, or if war involving weapons of mass destruction cannot be averted, and thus is being disclosed in large part for humanitarian reasons.

4-PASS as a system of systems comprising methods for creating compound and complex apparatuses out of coordinated simpler units, and the simpler units themselves are apparatuses with innovative apparatus and methods for set-up and use in myriad ways as stand-alone units in their own right. The MONAD is the basic 4-PASS atomic unit. In terms of materials out of which MONADs may be built, their size, number of sides, rigging, underpinning, coverings & so forth, and mechanically as well, there is a great range and variety of workable options for units which will fit within the 4-PASS C&C systems and the larger 4-PASS System. The particular combination of intentionally maximally generalized characteristics designed into a basic unit tend to be inherited by the derived combinations, that is to say, by the compounds and complexes composed of and created out of MONADs; and this is the ultimate source of the system's ground-up hyper-multi-functionality.

There seem to be at least two main strategies available when one seeks to maximize multi-functionality. One strategy is exemplified by the Swiss Army Knife. It involves niftily packing several broadly useful, but still specialized tools into a single unit. Despite inevitable compromises, a great deal of Nüftigkeit, or general and handy usefulness, can be achieved through this design approach. However, it is not, let us emphasize, not the approach 4-PASS has taken. Another available design approach, and the one that 4-PASS has chosen in the pursuit of radical multi-functionality, is quite familiar and readily exemplified by the Human hand. A number of like units (digits) are arranged fairly symmetrically, strong enough to hold themselves in position, but flexible enough to articulate at multiple points and work in tandem, in unison, or separately. Maintenance of an axis between the center of the palm and the finger tips allows for strength at the finger tips when they are drawn together, even though the physical connection does not lie on that specific axis, but rather goes round about it. The redundancy of the fingers is remarkable: many have known skilled crafts people who have lost all or part of more than one digit without apparent diminution in dexterity necessary for their craft. The analogy extends to the level of 4-PASS compounds and complexes, for hands not only work beautifully in pairs (in part by virtue of the symmetry already noted), but also in much larger aggregates as witnessed by the much of the construction and manufacture that is achieved collectively and cooperatively.

4-PASS does not map well with extant industrial categories. It spans such broad categories as catastrophic emergency relief equipment and shelter, decks, tents, garden structures, watercraft, houseboats, pre-manufactured housing, tanks and vessels, satellite dishes and antennae, enclosures, agricultural structures, scaffolding, towers, walkways, landings, furnishings, and a variety of watercraft from barges to pleasure boats. In this sense, 4-PASS is a superset of conventionally recognized structural categories. In the main, 4-PASS pertains to the very broad class of easily transportable and rapidly erectable temporary or semi-permanent foldable and self-standing or floating framed structures that are designed to be reused and reconfigured freely, in contrast to more permanent buildings secured to foundations and having their components permanently fixed in relation to one another. (ironically, there is a major exception to the distinction just drawn: because of their suitability as drilling platforms and as the basis for progressively lifted floating or injection-type concrete forms, MONADs may form the basis for laying very strong moorings and foundations suitable to the most permanent type of construction over land or shallow water. But this exception having been noted, let us return to discussion of the rule that MONADs may serve well where more permanent structures would be unnecessary or unsuitable.) Thus the parts of a single MONAD, in particular embodiments, have the capacity to articulate and slide, allowing platform, legs, sides and topside to vary in their spatial relationship. Used in 4-PASS compounds and complexes, MONADs enjoy this same flexibility in terms of free configuration, convertibility, and reuse to a degree much greater than, for example, a train car, not to mention a permanent building. A better analogy would be to say that what the automobile is to transportation systems the MONAD has promise to be relative to transportable and rapidly set up framed structures and devices of many kinds.

The following are sixteen purposely very general characteristics, or cardinal qualities, that define the MONAD in particular embodiments of the invention:

1. Platform-based
2. Polygonal 3-x sided regular and closely allied equilateral platform shape, and also highly symmetrical above a below platform.
3. Multifunctional central tube (hub) defines central axis.
4. Girding chinch-binding up-right peripheral elements.
5. Radial structural members or tracks in some cases locked with flanges.
6. Foldable/modular frame with, in some cases, hinged and sliding, clamped joints.
7. Hard, sectional floor/deck.
8. Self-elevating and stilted.
9. Almost all-terrain, almost all-weather, and almost all conditions capabilities for setup and deployment.
10. Interchangeable runners or footings below.
11. Suspendable and self-hoisting in some embodiments.
12. Convertible topside: concave/convex.
13. Stackable, multi-storied capabilities.
14. 100 percent coverable-interchangeable multi-layered coverings and aperture or skins.
15. Rapid setup optionally equipped for instantaneous self-erection.
16. Indefinitely scalable, interlinkable, and extensible.

There are at least six variants of the MODAD that meet this entire set of criteria, purposely radically general in its demands. Thus, even in terms of basic frame design, there is more than one embodiment for the MONAD capable of serving as a broadly multi-functional device either individual or in concert with other MONADs of any type. Masted types were the first discovered and defined, and are likely to be the main type, so this is the manifestation covered in greatest detail in these disclosures in order to convey an idea of how all MONADs can be concretely realized.

In regard in particular to the masted-type M-MONAD:

Nearly all 4-PASS MONADs possess radical radial symmetry. Equilateral polygons with 3 or more equal sides are formed out of members radiating from a central tubular unit. As a rule, these platform supports have all equal angles as well, although there are a couple of exceptions. Any M-MONAD frame can best be drawn, described and understood once it is seen that it is composed of assemblages of three articulated and elongated members (track, mast, and rafter) terminating above at a flattened cylindrical element (sky hatch, or upper hub) and below at a flanged, cylindrical element (lower hub). The hatch and hub are common elements shared by nearly all the embodiments, so there is only one lower hub and one hatch or upper hub per MONAD; however, there are as many assemblages of elongated members as there are vertices: 3 or more.

There is no theoretical limit, but as a practical matter, 5-, 6-, and 8-sided MONADs are expected by the inventor to have the most utility, with significant but lesser demand anticipated for 3-, 4-, 10- and 12-sided units. More than one platform may be stacked so as to share hubs, rafters, sky hatches, but with separate tracks, or this may be accomplished by extending coupling two or more hubs and masts. The stacking of platforms (particularly in pairs) has great significance for creating compounds and complexes, because it makes possible inter-clamping of staggered M-MONADs. The joints of every juncture in the each assembly are hinged, with the consequence that all motion of which an assemblage is permitted is confined within a single plane. Because the assemblages share two common elements, the hatch and hub are maintained in common axis even when not directly physically connected.

In addition to allowing articulation at variable angles, some of the joints between members allow sliding, or translation, with subsequent fixing. A track slide in some preferred embodiments allows the masts to move along the track and to move up and down in relation to the track A mast slide joins mast and rafter, and allows these two members to vary their juxtaposition, so that the entire topside (rafters+hatch) can be raised and lowered. Fixing means that mast and track slides can be clamped or fixed in place at any point along the member on which they slide. It is not merely the mechanical device (such as pressure fitting) used to fix the slide which holds the top side up: a girding element (cinch) is employed in some preferred embodiments As a cinch is tightened or winched up, it has the effect of lifting the masts upright.

Two of the principal elements typically lie on single axis. The lower one is called the hub, or lower hub. The hub's functions are manifold. In various compound and complex (C&C) Systems, the hub functions as (or in lieu of): floor beam, portal, window, door, drain, air intake, air filter, plumbing or electrical hook-up, masthead, center pole engine housing, hold, center support, fireplace, cistern, safe, etc. Generally, the lower hub functions as a sheath for other tubular elements within the MONAD, the elements running up through the platform, and thus may be likened to a spinal cord. However, two hub functions must be highlighted for basic understanding. (1) To allow M-MONADs to fold, hubs are hinged to their adjacent members called tracks. (2) Once tracks extend outwardly normally at equal angles from each other, hubs clamp the tracks perpendicular to the hub's axis. A pair of flanges may be used as the clamp, or alternate embodiments may have one flange that can lock the tracks securely using other available techniques. There are various ways hubs can telescope or otherwise be extended under load.

The upper axial member is called a sky hatch, or, in some cases, an upper hub. A direct connection between the two axial members, hub and hatch, is available but not required. A crucial innovation of the apparatus in preferred embodiments is that it maintains the alignment of these two elements along their axis in either case, whether or not they are directly coupled, and that it achieves this by means of a number of intermediate members that not only are hinged together, but which are allowed in some embodiments during set-up or use to vary their position relative to one another, yet all the while maintaining themselves within their single plane. But since the sky hatch is only sometimes directly connected to the hub completing a circuit (as a yogi's fingers and toes are only sometimes directly connected when he or she chooses to interlock them), in contrast to the hub, which is always directly connected to the tracks.

Tracks are an important member to understand. Whatever their form, they must be hinged to the hub so that the M-MONAD can fold (collapse when desired), and by whatever means, they must be held rigidly in place at (or about) 90 degrees to the hub's axis when the M-MONAD is set up (so not collapse when in use). Tracks and hub as a rigid, clamped unit constitute a platform frame, and may support a deck. Tracks have other uses as well. They may hold joints called track slides, which in turn hold the next major members, the masts. Tracks can comprise mechanical means for forcing the slides, and they can comprise conduits for electricity or water. There may be linkages, such as cable, that raise and lower either platforms or topside up and down relative to the masts.

At the ends of tracks, beyond the masts, there may be hitches, a primary means of joining and interlinking MONADs. Additionally, hitches may help support runners like wheels, skids, keels or skis. Hitches may be used as additional connecting points between stacked platforms or for railings at the edge of platforms. Hitches are of great importance in allowing MONADs to participate in compounds and complexes, so in some cases standardization of the coupling unit is accomplished. While the number of sides permitted for a MONADs is open, strict standardization of the length of sides is desirable because it will permit MONADs of differing numbers of sides to make a two-hitch interlink. One-hitch interlinking, or staggered interlocking, would still be available for coupling MONADs of differentsized sides.

A joint between track and mast, namely the track slide in one embodiment, is very important for set-up. One method of set up basically involves merely sliding track slides (like shuttle cocks) outward to their final position and inserting the masts (through the mast slides hinged to the rafters) and then into the track slides. It is then an easy matter to hoist the topside using a winching capability built in each MONAD. Another more elegant method is used when the M-MONAD has been stored or folded as a single unit. This second method again involves sliding the track slides to the end of the tracks, but this time under load, since the bases of the mast already are pre-inserted in the track slides, with all the rest of the weight of the top part of the structure on top. Moving the track slides out results in raising the topside as the masts become more upright. It is the bases of the masts that move, not the tops, because a winching cinch girds the tops of the masts. Actually, the second method is available even when the topside and masts have been stored as separate modular assemblies, as will sometimes be desirable so as to divide the weight into more easily managed parts. However, when a lower hub larger in diameter than the upper hub is employed, the unit may be raised using the second method, but will have to be restored as two modular assemblies. For emergency use, for example during storms at sea or highly contaminated sites, air bag technology can be used to set up the frame instantaneously to the point that a sterile chamber with filtered air supply can be entered and setup completed from within.

Masts articulate with rafters, and the joints between them may be called mast slides. Everything above the slides can be raised or lowered up and down the masts because of the reposition that the mast slides permit. When locked in place, mast slides hold one end of the mast while the platform beneath is being raised or lowered relative to them. To have all the angle variability required for folding, and to permit all the motion of rafters above and tracks below relative to masts, may make it seem as if nothing is fixed. But in reality, if counter-intuitively, all the movement is confined to a single plane, which if it meets other like linkages in intercepting planes, will be the basis for a strong standing structure.

The variation of angle between tracks, masts, and rafters provided by the hinged track slides below and the hinged mast slides above are what allows the topside of the MONAD to convert both ways between concave and convex, and become very strongly held up in either position once the track slides lock the masts back into the vertical.

In some embodiments a winching cinch attaches to mast slides. As the cinch is loosened, the masts will tilt outward unless they are locked to the vertical. This is precisely what one wants to allow the rafters to straighten out horizontally so the sky hatch can be lowered to create a concave topside or lifted to create a convex (roof shaped) topside. The cinch of course can also be locked into position when the masts assume their upright position, at which point it functions like a hoop to a barrel.

The sky hatch resembles the hub in that it may be an outer tube that sheaths other tubular elements such as a chimney or fume vent, water intake, grain intake, antennae receiver armatures, active solar distillation tubes, etc. For some applications a Plexiglas skylight which may be normally used must be removed from the sky hatch. For emergency use over contaminated grounds or waters a one-way air valve is employed in the sky hatch so that all incoming air supply passes through filter in the hub.

Main Components:

Covering Skins:

Most covering skins will be soft and pliable, allowing some of them to fold right in with the frame for storage. Of course, there is nothing to preclude bulkier soft covering or sectional hard coverings, which would be folded or stacked respectively. They will be made out of material like screens, tarps, vinyl canvass, reflective Mylar, etc. The generic name used for all the coverings will be skins. Skin types include among potentially others, include: Light and Heat Reflective Skins, Electromagnetic Radiation Reflective Skins, Solar Screening Skins, water impermeable Slick Skins, Insect Screening Skins, Insulating Skins, Sound Proofing Skins, Photovoltaic Skins, Fire and Smoke Resistant Skins, Aperture Skins (doors, windows, portholes, vents), and Transparent Skins, either for viewing through or for passive solar & green house use. Other types include Net Skins, Trapping Skins, and Semi-permeable Skins. Skins used only below deck and reaching to the ground can be termed Skirts. We shall see skirts have many uses, particularly in agriculture, to confine sprays, dusts, and biological pest control predators. Flaps, useful as awnings or blinds, and attach to tops of the side skins.

Most skins will be of flexible, fabric-like materials, but there is nothing to preclude thicker, stiffer skins that would be stored as sectional sheets. (Of course, decking will need to be stiff and stored in sections.)

Side skins may be rigged to roll up and the down like blinds, and are held together at the sides by something like shower curtain rings, with the sides of two adjacent skins sharing the same pole (or mast) and the same rings. Top skins may be held in position with bungee cord, Velcro, grommets, or other simple means. Some top skins may be further secured by cinches, straps, snaps, Velcro, zippers, stays that may be inserted in grooves.

For emergency use in locations contaminated by nuclear waste, biological or chemical agents or weapons, layered impermeable skins, simple as 4 or 5 sheets of 4 mil vinyl sandwiching a mild adhesive combined with potent sterilizing germicides and neutralizing chemicals, might save many lives. There may be multiple skins sloughed off whenever called for. Sheets may be in some embodiments peeled off for proper disposal without further exposing patients, other occupants or contents. In dusty climates particularly, a mild adhesive left on the surface of a skin could do dual service: snagging harmful airborne particles like flypaper, and rendering some of them harmless.

Within MONADs, interior partitions or curtains might be made of similar material. Multiple showers, changing rooms and air locks that could be vital to help affected populations in such dire environments might well employ such embodiments of the skins. Multiple layered disposable skins proposed in the previous paragraph could serve well for the interiors of such MONAD shelters.

The Lower Hub:

The central cylinder, like a large, doubly-flanged telescoping pipefitting, is called by the inventor the lower hub, or, in some cases, just the hub. The hub is a crucial load-bearing and load-distributing member. Rubber mounts and sprung hydraulic mono-shocks may be used for dampening vibration and easing wear and tear on the radiating tracks that feed into the lower hub. It is not merely threads of flanges around the hub that might provide all-important solidity through the hub, but much more the clamping action by means of threaded bolt or other simple mechanical means. In fact, most likely compression fittings rather than threads will connect flanges to hubs. It would be a mistake to consider the hub two-dimensionally (merely as a wagon wheel), for its cylindrical height definitely matters, and being telescopic or adapted to take extenders, that height is variable both above below the platform level.

Another embodiment of a bottom flange has grooves for the tracks to fold down through. It is rotated into position under the tracks when for set up. Pivoting tightening bolts like those on a canning pressure cooker, could easily be fitted to modified standard large pipe flanges.

One would merely saw from the rim of the flange to each bolt hole to create a notch wide enough for a bolt to pass. The radiating tracks are hinged to the top flange to allow for folding up 4-PASS devices. Actually, these hinges need only be stout enough for folding and unfolding the frame, for they do not bear any weight when the 4-PASS device is actually up: it is the clamping action of the two flanges in such an embodiment that does the real work.

A viable alternative approach would be to beef up the hinges so that they could support the load even without the clamping of a lower flange. The advent of seismic retrofitting has meant that "hold downs are strong to do their intended job and cheap because they are mass-produced. Supposing single square tracks were used, they could terminate centrally with such hold downs hinged to the upper flange. When the tracks were unfolded in set-up, the heel of the hold-down would rest at a right angle between the hub and the bottom of the top flange, holding the platform at the desired 90 degree angles to the hub.

Like the mouth of the octopus, the hub is a multi-purpose portal as well as a key structural member. In addition to being the central structural member, the hub in many embodiments is also capable of performing the following functions (some in conjunction with additional Methods And Device Extensions):

Telescopically Upward Extendible: Crucible, kiln, solar oven, desalination still, and electromagnetic receiver, when in use, are all supported through by the hub in its upward extension. A Hub-Topside Adapter fits over the top of the hub and provides convenient access to brackets which permit further upward extensions through the skyhatch for kilns, ovens, etc. The topside itself, normally of course self-standing, rides out severe storms directly supported by the hub without any adapter and with very little upward extension.

Telescopically Downward Extendible: Extending downward, the hub is attached to, and passes through, the central flotation unit (in its simplest form, merely an inner tube.) Further down, again in severe storm situations, it supports the ballast and sea-anchor which make the platform above self-righting and sea-worthy as a buoy.

Air intake, fan and filtration: The hub lets every MONAD so equipped create a positive filtered air pressurized system Saltwater pickup: In desalinization use, water is picked up through this aperture.

Fresh water output: Again, for desalination applications, where fresh water is pumped to central collecting cistern, tank or shore.

Fresh water collection funnel point: In the inverted position, roof serves as a giant rain funnel, the hub forming the narrowest part of the funnel. A plastic water bladder may filled by this means even over water Outer sleeves: These are used as alternate or back ups winches and take-up spools for the winches normally employed for the self-elevating and lowering capabilities. A handle of suitable length supplies the required mechanical advantage.

Special Uses: Larger hubs may be used for diving, drilling, swimming, & bathing. The hub is very useful when the 4-PASS device is suspended, as for helicopter rescue work or arboreal deployment. Due to the weight balance conferred by MONADs' symmetry about a point, they have favorable characteristics as airlift platforms, and the fact that the hub can extend upward raises the pivot point of a cable running right down from the chopper through the hub and secured by locking hook at the hub bottom: precisely the strongest point of any MONAD. The advent of a covered and even as need be airlift platform may well be another patent quality of the 4-PASS MONAD.

Use as Holds and Safes: For prolonged deep water use, sealed compartments within hubs would allow stowage of provisions below or near the water line. As supplies were used up, the hubs could be hauled up a notch or two at a time to reduce drag.

Optional Motor Chamber: The hub could contain an optional motor, when desired, of in-board out-board type, off of which could be run in addition: pump, generator, power winches, and desalinization equipment. Maintaining weight over the center and even weight distribution are quintessential to this design. Concentric cylindrical gas tanks within or around hub might even be considered, as would tubular tracks doubling as fuel tanks. In the case of a motor, sound insulation would be important. Additional vibration dampening might have to be addressed, but note that rubber mounting of track to hub by way of flanges is contemplated in any event to minimize wear and tear where members and hub meet.

Use as Pot Bellied Stove: Mounts on top for use in extreme cold survival situations. Since the family of 4-PASS devices has a number of renewable heating sources, this will not have to be resorted too often. The Nave (roof opening) and upward extension of the hub provide venting. Central position of heater should create an efficient use of radiant heat from combustion.

Table Top mounts above Hub. Can be slipped down to floor when not in use.

Winch control panel mounts below table top; it unfolds to reach beyond table top or folds to stow neatly underneath table top.

Tillers fold like winch panel under table when not in use.

Radiating Tracks:

The radiating tracks in most embodiments double as the main platform support members. In one embodiment they are composed of two parallel pieces, of wood in the simplest versions, extending to each angle of the polygon; thus the hexagon versions may have twelve members making up six tracks. The tracks are useful because the masts can extend through them, and the bases of the masts can be pulled outward from the center to their final position a couple of feet, in some cases, from the deck's outer edge. (This is to allow support for an outside deck beyond the domed cabin, as well as to make sure the deck overlaps the flotation units.)

Where cost is less critical, square stainless steel shafting with square linear bearings might used both for tracks and masts. This would eliminate the need for parallel shafting and it would clamp easily between the hub flanges.

Track Slides in the embodiments that use them perform several important functions. They hold the bottom part of the mast in place while it is slid into position. When it is necessary to lower the dome, for example to ride out a storm, the slides allow the masts to slide as they are dropped down. Sides may have shackles or pulleys attached to allow their movement along two axes. Note that it is the slide that allows the platform to elevate by pulley action. Ropes or cables that operate the slides generally pass between the or just under the tracks of the cable. The pivoting action of the slides allows the masts to fold together umbrella like for storage. Nylon sleeve bearings might be employed on low cost versions, while linear bearings would be use where cost was less critical. There are many alternatives for the track slides in terms of bearings, from furniture foot skids to self-lubricating sleeves to ball bearings.

The dual track itself could be replaced in some embodiments by bars with a linear slide or a round slide holding circular bearings, or 2) a worm gear covered by a single slotted track as seen in some garage door opener designs. Pneumatic, hydraulic, or chain driven mechanical approaches are explicitly appropriate here, as well as for raising masts in relation to decks, and probably preferable in more sophisticated versions where cost is less of an object. Indeed, linear clutches are available that permit travel up of any length up smooth rotating cylindrical shafts. Wooden tracks might be tapered on the ventral side toward the outer ends, and beefier near the flanges.

Spacers may be used in some embodiments as articulating crosspieces keeping the radiating tracks evenly apart. Three hinges may be used per spacer. The same rope or cable that draws the sliders into position may be used to lock the spacers in place. They work like the articulating braces that hold the legs of a folding table in position.

Track endblocks are bookend like braces that track slides lock into and are supported by in their terminal outward position. Shown in turquoise in these illustrations, you can see how the slides slip into them at the end of their outward movement.

At their extremity, the tracks may terminate in hitches. Hitches may be of a ball and socket type. This is a feature that enables the 4-PASS devices to interlink laterally and be configured in arrays of indefinite size.

Decking:

Decking may be of plywood or any other suitable material. Composites composed of resins on carbon fabric or Kevlar over a thin plywood core would likely be used in the lightweight versions. Decks may take the form of pie-shaped slices, with the small ends cut to accommodate the hub, and the arc side cut to make one side of the polygon. In larger layouts, there may be one pie shaped piece (generally long enough to cover a segment of the inside decking, and one rhombus-shaped piece to make up the adjacent outer decking. Trap Doors may be provided at appropriate points for storage, access to services areas, etc. Recessed tie-down hooks may be located especially near outer walls so that plastic utility trunks (doubling as benches) can be fixed in place.

Masts:

Masts are typically pole-shaped members able to support the topside, platform and skins both above the and below the platform. It is worth emphasizing that masts can typically be raised and lowered relative to the deck on slides by pulleys, worm gears, hydraulic, or by other mechanical means in various embodiments. In low-cost versions smooth steel rings or carabineers should provide sufficient means for raising and lowering the masts in tandem. In high-end versions, the yachting world has marvelously lightweight blocks, fiddles, etc. For most purposes, industrial block and tackle hardware should prove very serviceable. The top of the masts may be capped with a mast cap, which may house a pulley block. Under the mast cap there may be a top mast slide, which will provide the junction between the rafters and masts. This pivots allowing the angle between and rafters to vary, and it slides, permitting the topside to be raised and lowered in various embodiments. The top mast slide may be locked (using pin, pressure fitting, ratchet, clamps, sprung pin or other standard mechanism). Note that the mast slides are also the nexus in many embodiments between mast and cinch (otherwise you could not lower the topside without lowering the masts). Bottom mast slides are the exact counterpart to the top mast slides in many embodiments, but perform their work below deck: to haul up nets, raise pallets, etc. The masts themselves may be of a shape that allows them to slide vertically through the slides and resist binding in the tracks. Something like flattened oval cylinders might be optimal, but for practical purposes, cylinders will be the norm. Masts may be made of a variety of materials or composites:

Tubular metal

Solid metal rods

Wood poles (dowels)

Solid metal poles with tubular extenders

Tubular poles with solid rod extenders

Bamboo (with some limitations)

The masts additionally may have extenders, which may be either telescopic or may use some sort of outriders. Extenders may be used also at the tops of poles to mount wind turbines or hyperbolic focusing rods, and below they have a great many uses, particular in association with fish farming, fishing, hydroponics, and as sea anchors. Extenders which touch ground are called stilts. Feet may be used at the end of masts or the end of stilts. Feet may be provided in various types and sizes, such as webbed feet for soft soils and snow. Note that the same hand or power winches driving other spools could be used to raise and lower the masts and extenders. Upper mast extenders may accept flexible focusing rods (see below).

Topside:

A word more general than "roof" has been chosen to indicate that this important component has many uses in addition to providing shelter from the elements. Topsides in embodiments of the invention are capable of being supported in either the convex (typically roof-like or pyramidal) or concave position (like a funnel). In either topside position, the topside can be supported in either of two convertible ways: 1) fixed (with center pole), or 2) floating (like a yurt: i.e. without center pole and without roof beams to hold up the rafter). The center pole in question is either the telescopic hub or an extender running up from the hub.

Rafters:

Rafters extend in parallel pairs in many embodiments very analogously to the tracks on platform level. The topside center may be an upper hub or a stout ring, called a sky hatch, into which the rafters assemble. Rafter pairs are attached to the hatch with rafter bolts producing a kind of hinge. On the outer ends, rafter pairs attach to the mast caps in most embodiments.

Rafters may have telescoping outer end members called awning supports, for the obvious purpose of providing shade on the outer deck.

Both functionally and aesthetically, the importance of the sky hatch cannot be overemphasized. Taking recourse again a biological analogy, one is tempted to say that is this feature that allows the 4-PASS devices to incorporate and switch between the two great skeletal patterns nature has let evolve: the exoskeleton and the vertebral column. Note that the sky hatch in normal use is basically a sky light; a central source of light from above is aesthetically and symbolically pleasing, especially where there is a dome-like roof to suggest the vaulted heavens. But this same feature makes 4-PASS devices particularly suitable to art studio use, and other applications where humans will need light, for example.

The pros and cons of a center pole are pretty obvious if you have ever sat at a picnic table with one of those incredibly durable canvass umbrellas supported by a pole jutting up through the center of the table. Great shade, but the pole sure gets in the way. It is just where you would want to place your chef d'ouevre, the pot for your poker game, or your Scrabble board. Unless they were inventive contortionists, an amorous couple in a center-poled two-person tent could become quite frustrated. Center poles can be extremely intrusive. Roof beams, which are so much a staple of permanent architecture, are not very suitable for temporary and semi-permanent use where portability, collapsibility, rapid set-up are paramount. For passive solar and greenhouse applications roof beams are undesirable insofar as they block solar rays. Like a bird's skeleton, above the platform base "strong but light" should be the watchwords for the structure.

The principle that allows a roof to float without beams is the same one employed by a yurt. A belt, rope or cable connects the rafters to sides. It works like a hoop to barrel. In this family of inventions, we use this element in a second way: as a mechanical means for erecting structures. To emphasize this very significant feature of the family: a key structural element is also a key part of the erecting mechanism. Quite simply, at their crucial load-bearing and transferring points, these structures will be cinched up, and that is why they will be cinch to put up. This is as if the keystone were part of the erecting mechanism needed to lift it as well as a crucial part of the finished structure.

In most embodiments the forces from the weight of the roof are directed downward and outward toward such as a rope or cable running all around the periphery of the tops of the structure's sides. Thus the more weight or downward force for wind on the top, the stronger the yurt structure (within the limits of the strength of the materials distributing the additional forces) to withstand forces (primarily wind)

from other directions. Thus yurts (more politically correctly called gers, at least in Mongolia) probably originated and are definitely at home in some of the most wind swept Asiatic high planes and mountain valleys with very severe continental climatic patterns.

The sky hatch accepts in some embodiments flexible focusing rods. These are like dome tent poles made of fiberglass, and might be broken down with the sections held together with central elastic cord. Such rods run over the pairs of rafters out to the upward mast extenders. They insert into the top side skins like sail stays.

Mast Slides:

As already described, mast slides are an important juncture between masts and rafters above deck, and serve to haul up such as sub-decks, pallets, and nets below deck. Normally, topmast slides are positioned very near topmast, just below the mast cap, so they are lockable in that position. However, there are some situations in which it is desirable to lower the topside without lowering the masts. If one faced heavy off-shore winds while returning to land over shallow water, for example, the masts stay up but the dome is lowered, and it is the mast slides that allow this. Any number of simple hardware options involving clamping or compression fittings makes this easy to achieve: the slides are kept in the desired position by tightening knobs or thumb screws. For marine use, means must be provided to release all the top slides simultaneously so that the top-side can be lowered quickly. One of many ways to accomplish this is to have sprung levers on each slide attached to light cables running up through the rafters, converging at a point on the sky hatch, with a rope with a handle hanging downward. A tug on the handle would release the mast slide locks, preparatory to winching down the topside. "Lowering the boom" would thus not be quite so potentially dangerous as on many sailboats. The slots visible on the inside of the mast slides are where the cinch passes through the mast slides.

Runners:

Floats, pontoons, skids, sled-blades, hulls and wheels are all examples of runners, which sit below lower extenders and allow mobility for structures based on the present invention. In the most basic form, floats may be no more than inner tubes protected by plastic snow disks or thick plastic can covers. A little more expensive are the various nylon-covered towable tubes offered by numerous manufacturers.

Where directional capabilities over water are desired, pontoons made of heavy, large-diameter capped PVC pipe (perhaps filled with smaller diameter capped pipes or non-porous plastic foam products) should do very nicely.

4-PASS devices have an unprecedented capability of freeing their runners from the main unit, as if you had a yacht you could sail some place and then split into six or eight sea kayaks or sailing dinghies for exploration or your own little regatta. Actually it is better than that, because members of the party get to keep using the yacht while others are out exploring. The stilted key characteristic of 4-PASS devices is what makes possible this extra modularity and functionality. Assume one has a 4-PASS device set up somewhere for cross-country shaped tubes on top of a 5 foot snow pack. If the kids want to go tubing; they can: just jack down your masts till they reach hard ground, and you can free your runners for the kids to use.

Note that this description assumes whatever tubes you used were U-shaped rather than O-shaped, because the mast extension must pass when the tubes are removed. Such towables already are commercially available. All oriented in the same direction for normal use, they would give a modicum of directional stability when used as runners. Of course, this means that 4-PASS devices are compatible with more capable inflatables; particularly around the center under the hub, one large runner could be used even if the peripheral tubes under each mast were left in place, as the latter might be quite sufficient to keep the main unit up in water too deep for stilts to be of any use. The almost closed U shape could be achieved with a simple truck tire tube, cut in the middle and both ends bonded shut with rubber cement.

Of course, for sports, recreational or middle or high-end commercial use, in addition to many proprietary designs, all sorts of existing pontoons and hulls could be adapted for use with 4-PASS devices: the key is having perpendicular downward extenders from a rigid platform to securely lash or attach them to, which is exactly what our design provides. In some models, the runners are personal watercraft like inflatable or molded double sea kayaks, so people on expeditions can land or elevate their shelter on its stilts and then paddle off on its flotation units! 4-PASS devices will be engineered to provide easy and secure docking of runners of all kinds.

Wheels for 4-PASS devices typically insert below masts, and are used mainly for positioning, rather than for serious overland transport (though platform based fuel cell driven vehicles are being designed). But long distance overland transport under power is seen as only as a rather remote adaptation for 4-PASS technology, which has so much more immediate to offer in many other areas.

Directional Blades:

Corresponding in function and design to kneel, centerboard, steering oars, rudders and the like, bladed devices, either mono-directional or rotating, may be affixed as downward extenders from hub or parallel sets of masts.

Below Deck:

Below deck usage may be very significant, but is partly dependent on the runners selected, whether amphibious capabilities are intended, and anticipated uses.

- Effluent Control systems are crucial if 4-PASS devices are to fulfill their environmentally friendly potential and purpose. Over water, expandable bladders, provided they were adequately shielded from below, would work without the necessity of supporting the weight of the black water or grey water. Well-engineered systems and hook ups like those in the RV industry must be demanded of every licensee.
- Fresh Water Storage likewise could be handled with non-rigid containers protected against impact, cutting or scraping from below, with gains over water storage on deck.
- Below Deck Dry Storage Bays, Nets, etc. would be important on longer voyages, and should be arranged to maintain weight balance and lower center of gravity.
- Utility inputs for gas, electricity and water should be facilitated by the highly symmetrical layout below deck.

Understanding how the M-MONAD works and whence the 4-PASS C&Cs and the whole 4-PASS System derive their far-ranging capabilities, there are alternative folding frame designs that might offer similar, equal, or even added, power or utility. Mast-less MONAD embodiments are introduced, and are still full-fledged MONADs, although they do differ in some particulars, particularly as pertains to the sides, so they may look rather different. It is still intersecting planes which hold up these non-masted versions, but instead of the planes meeting centrally, they intersect where the sides meet. Top-sides including sky hatches and hubs are almost or completely unchanged in these variants, which primary involve the lateral "walls'" of the fame's skeleton, when masts no longer are employed.

The X-MONAD variant takes its name from the fact that in lieu of masts, scissors-shaped flat slat pairs connect tracks to rafters. Instead of the pin of the scissors, a sliding joint is employed to permit folding or unfolding. The cross members (slats) are fixed together (bolted or clamped) by tightening a knob or similar device for rigidity once the frame is up. (Actually three slats be used in place of a pairs as described: two thinner ones in one direction sandwiching a thicker one in the other direction). Cylindrical tubular or rod tracks are used, but there is no need for square monorail or parallel dual member tracking, because there is no need to keep any mast in the same plane as tracks and rafters. Instead, the mast slide is a thrust bearing with a fin. Hinges to the adjacent base X-members are attached to the fin so that they may rotate on an axis perpendicular to the fin, which means parallel to the track.

This allows all the motion necessary to allow folding as a single unit on the exact same lines as the elegant method for masted MONADs. Slats are used so that each scissors pair is held in a separate plane, but all these planes intersect precisely at the axis defined by a rafter end and track end. The rafter-slat intersection is like the finned track slide arrangement just described, but it is a fixed instead of sliding joint.

Instead of confining movement to planes converging at the axis of hub & sky hatch the M-MONAD does, the X-MONAD is held up by generating planes that intersect precisely above the vertices of the polygonal platform; where the masts would have been if we were using masts. Provided the polygon has any number of sides except four, a very strong frame results.

X-MONADs have their pluses and minuses compared with other types. Doors are a bit of problem, since one facet requires special treatment. Cables can be used from the top arm vertically down to the foot, or better uncrossed poles can be provided. A pull up bar then will add strength placed above head height. XHX gives the idea of how doors may be handled. Without masts there is no ready way to vary the height of the topside on the fly. Elevation can be very effectively accomplished, but without masts, stilts are used: these may be mounted at track ends fitted with thrust bearings, and the stilts can be deployed up or down much like masts in M-MONADs. X-MONADs excel for uses like aquaria, tanks, pools, etc. where a way to handle extreme outward lateral forces is required. In places like the Aleutian Islands or Tierra Del Fuego where very high winds are the norm, X-MONADs might be most effective. Particularly when stacked, with two or more platforms sharing hub, they will be very resistant to inward pressures as well, suggesting important marine uses such as for semi-submerged vessels. Since poured concrete forms are such a case, their application in this area is anticipated. X-MONADs have different staggering characteristics than Masted MONADs.

X-MONAD set-up is very comparable in ease and rapidity to erection of other types, but X-MONADs are the very best suited to instant pneumatic set-up using modified airbag technology. For applications like humanitarian rescue and relief in contaminated zones they would save vital time, and so may be unsurpassed among 4-PASS MONADs found so far.

The Sigma-MONAD or Σ-MONAD:

From the front the Sigma-MONAD or Σ-MONAD utilizes a shape familiar from extension tongs, drawing devices called pantographs, or scissor lifts. So it appears shaped like a numeral 3 and Σ superimposed on one another, but it is not limited to two in terms of the number diamond shaped parallelograms formed. These units are located at the axis's perpendicular to the tracks on the axis running through the vertices of the platform bases; in other words, exactly where masts were located on the M-MONAD. Folded, they extend laterally half way along the sides above and below platform height.

From the top, one would see that each set are actually angled to match the angle of the vertices. On the sides these struts are pinioned together in the normal scissors fashion, but at the angle they utilized ball hinges (or other suitable means) to compensate for the compound mitered angles at which they travel in relation to each other. The scissors units compress like an accordion, and can extend much higher than masts normally would, and much lower than stilts normally would. In the compressed position what one sees are very vertically compressed and horizontally elongated diamond shapes, which, as the horizontal points of those shapes are drawn together, the diamonds become very tall in the vertical direction and very narrow horizontally. Of course, winches again could be used to, but this type of mechanism is particularly suited for use in conjunction with threaded rods. Some car and truck jacks work on this principle. Take note that in is only one diamond in the chain that needs to be re-dimensioned, and (like Mary's little lambs) the rest are sure to follow. Sure, that is, to the extent that the members are stout and stiff enough, to bear the loads coming from so many different angles as they must in traveling from near horizontal to near vertical, or vice versa. Once topside and deck are up to the desired height, the cables running diagonally from "elbows" to deck are drawn taut, resulting in a structure tight as a drum.

From a theoretical design standpoint, the X- and Σ-MONADs represent a variation of by now familiar 4-PASS strategies: the tendency to unite the erection mechanism and the finished structure, and the idea of confining motion in certain intersecting planes while the rest are left variable through the use of hinged joints among members. Notice how unaffected the hub-track and topside assemblies are. This may be taken as confirmation that the different MONAD types represent various embodiments of the MONAD ideal, however different seeming in the planes they confine or leave free or in the appearance of their skeletal frameworks. It is hypothesized that the larger systems' compatibility and other requirements of a highly modular system imply a set of principles likely to be demonstrated in any incarnation of the modular unit capable of serving as the fundamental building block for such a broadly conceived system of systems.

Σ-MONADs may be stacked for storage like pancakes, rather than like umbrellas. Several advantages and limitations of this MONAD type should be pointed out. On the negative side, weight and cost may be higher due to the more complex joints and stronger struts necessary. However, this may prove to be the giraffe among MONAD s, excelling in the areas of self-elevated and stilt utilization. A nice capability is that once up the sigma columns can be drawn together (by sliding in the track slides), and thus a very strong tower with a wide base can be quickly created. The number of obliquely joined triangles that can be created by bringing the "elbows" of six or eight such scissors assemblies together is truly impressive. In fact, so great is the potential strength of such a structures, that the possibilities for a portable crane arm cannot be lightly dismissed! Again, definite possibilities for instant concrete forms present themselves. In fact, there is no reason that several concentric sets of scissors assemblies could not be arrayed on a single platform base, making possible pouring of towers ringed like trees, with the assembly members and cables serving as rebar as they became encased. Such formations can be the basis for very strong ladders as well. It is anticipated that the Σ may be the MONAD of choice for broadcast antennae and wind turbines that need to be set up very quickly.

The W-MONAD:

The W-MONAD can be understood as a kind of hybrid between the M-MONAD and the X-MONAD with a little of the Σ reclining on its side. It is not unmasted. It has masts all right, plus it has sliding accordion criss-cross diagonal frame reminiscent of the Σ but rotated 90 degrees. Each mast has two such assemblages. Each of these faces toward an adjacent vertex, and there is a channel provided at deck level along the lines of some sliding closet doors. Drawing the W-shaped assemblages together produces a diagonally cross-brace much like the X-MONAD enjoys.

IWWIWWI . . .

Many variations are possible, but the idea is to make a strong cross-brace available when necessary, and yet be able to fold it away next to the mast other times. They make excellent doors, which of course is of particular interest in rescue work in contaminated disaster scenes where progressive airlocks may be vital.

For high wind areas and marine use, the cross-bracing has obvious advantages. Indeed, the W-MONAD's accordion wall frame apparatus may be offered as an add-on extension for M-MONADs. The W-MONADs' sliding cross-braces may be useful below as well as above the platform level, and should see wide application whenever multiple stories for C&Cs are called for. Beneath the waterline, the W braces can stiffen skirts greatly. For winterization, the W-brace will aid in creating needed dead space.

W-MONADs fold like M-MONADs, but of course cannot be expected to make as tight a cylindrical folded unit, and are necessarily heavier. The deck level channel articulates and folds in sections as well. A limitation of W-MONADs is that they reduce the extent to which the topside can be lowered down the masts. W-MONADs have limitations when it comes to staggering them to form composite structures, but the sliding cross brace is so easily removed that this may not pose too big a problem. With time it is anticipated that more fundamental MONAD variant types may well be discovered.

Non-Regular Polygonal MONADs of Closely Allied Shape:

Even in its severe minimalism and purism when it comes to making regular polygonal shape for the MONAD the rule, 4-PASS theory does allow for well-reasoned exceptions, perhaps betraying again its language-like nature. The inventor pleads that these exceptions be made few and far between, and only after considering whether the addition will usefully extend uses in the Modular mode in view of tiling theory. Hoping this does not confuse anyone as to what should be the general rule, and what might be the rare exception, I advance only two at this point, an equilateral hexagon and a rhomb. Both preserve maintain the cardinal qualities that we have used to define the MONAD.

The Equilateral Hexagonal MONAD:

This MONAD creates a polygon with vertices of angles of $3\pi/5$, $3\pi/5$, $4\pi/5$, $3\pi/5$, $3\pi/5$, and $4\pi/5$. Sides are all still equal, but 4 angles are more acute, and 2 angles are more oblique than for the regular 6-sided polygon: the hexagon. This form bears a definite relationship with pentagon, as can be seen if we generate five of these MONADs, rotate each one 72 degrees (72×5=360) and arrange them as shown center. You can construct your own Equilateral Hexagon out of 6 regular pentagons of an identical size, by creating two pairs of pentagons, each pair with one adjacent side, placing the pairs so that the concave portions are facing [somewhat like this < >], and completing the form by putting one of the remaining pentagons so the vertices of one side coincide with one vertex from each pair, and the last remaining pentagons do the same on the opposite side.

This secret affinity between hexagon and pentagon is something a mystic like Pythagoras, or indeed his disciple, Kepler, might have best appreciated, but our interest is more utilitarian. According to Grunbaum and Shephard, an uncountable infinity of tilings is possible with hexagons of this proportion. Herringbone patterns are easily produced, but there is no difficulty changing direction at will:

This gives greater variety of architectural possibilities than that hexagonal marvel of nature, the honeycomb.

In the autonomous, stand-alone mode, the equilateral, unilateral hexagonal MONAD offers, with the addition of one or two triangular MONADs, a shape of great interest from a folding boat and ship design standpoint:

Next we come to another embodiment of the MONAD that also has equal sides but two different angles.

The Rhomb MONAD:

This equilateral parallelogram has angles $\pi/5$, $4\pi/5$, $\pi/5$ and $4\pi/5$.

Once again we encounter an even-sided figure that can be constructed from the pentagon. In fact, it is in relationship to the pentagonal MONADs that the Rhomb MONAD becomes of greatest interest. Two pentagons and two rhombs combine to make a form with special nautical, packing and docking qualities. You can construct your own rhomb out of 4 pentagons of identical size, by creating two pairs each with one adjacent side, and placing them so that the concave sides of the pairs are facing, with two opposite vertices coinciding.

Modular rafts or decks on any scale are rendered possible with MONADs of these two shapes, and the MODULAR compounds or watercraft may detach or reattach very readily. The docking is very like the way receptors for antigens are often represented.

In its autonomous mode, stacked (i.e. with top and bottom platform) the Rhomb MONAD offers the basis for a folding double sea kayak, pontoons, and other hulls.

It will be apparent to the skilled artisan, given the teachings above, together with the many figures provided as well, that there are a great many variations that may be made in embodiments of the invention disclosed, without departing from the spirit and scope of the invention. Many variations have already been described. Variations in structural materials may be made, variations in size and shape, and variations in combinations of features of the invention described above may also be made without departing from the spirit and scope of the invention. Therefore the invention should be accorded the scope of the claims that follow.

What is claimed is:

1. A foldable, deployable framework for a structure, comprising:

a lower hub having a first central axis;

a set of three or more equal-length tracks each having a first track end pivotally attached to the lower hub such that each track pivots in a separate track plane parallel to the first axis;

a set of three or more masts of equal length, the number of masts equal to the number of tracks, each mast having a first mast end pivotally and translatably attached to one of the three tracks such that the masts pivot on the tracks in planes parallel to the planes of the attached tracks, and the first mast ends are free to translate along the length of the joined track;

a set of three or more rafters of equal length greater than the length of either masts or tracks, the number of rafters equal to the number of masts, each rafter having a first rafter end pivotally attached at a second mast end, opposite the first mast end, to one of the three masts, such that the rafters pivot in planes adjacent to and parallel to the pivot planes of the attached masts and tracks; and an upper hub having a second central axis coaxial with the first central axis of the lower hub, with each rafter pivotally attached to the upper hub in a manner allowing the rafters to pivot in their respective rafter planes;

characterized in that the framework deployed has the tracks in a common plane substantially orthogonal to the first axis, defining, with the lower hub, a structure floor, has the masts each at substantially a right angle to the joined track, at an end of the tracks furthest from the lower hub, adjacent masts defining structure walls, and the rafters at an obtuse angle to the joined masts such that the axes of the upper and lower hubs remain coaxial, the rafters and upper hub defining a structure roof.

2. The framework of claim 1 further comprising locking elements between the first mast ends and the tracks enabled to lock the translation of the first mast ends at any position along a joined track.

3. The framework of claim 2 characterized in that the framework folded comprises a package with the first mast ends translated to a position adjacent the lower hub and locked in that position, and the masts, tracks, and rafters pivoted to lie adjacent lengthwise, forming a package of outer cross-section defined by the hubs, and length defined by the rafter length.

4. The framework of claim 1 wherein the deployed framework further comprises hub-to-track locking elements to lock the tracks and lower hub into a common plane.

5. The framework of claim 4 wherein the hub-to-track locking elements comprise at least one flange to which both tracks and lower hub may be affixed.

6. The framework of claim 5 comprising two flanges translatable to clamp tracks and hubs in a common plane.

7. The framework of claim 1 wherein the deployed framework further comprises locking elements to lock each set of joined track and mast into a right-angle relationship.

8. The framework of claim 7 wherein the locking elements comprise pins passing through openings in each of joined masts and tracks.

9. The framework of claim 7 wherein the locking elements comprise brackets that, affixed to each of a mast and a track, lock the pivot between mast and track.

10. The framework of claim 1 further comprising a telescoping central post joined to the lower hub, and extendable toward the upper hub, away from the upper hub, or both.

11. The framework of claim 1 further comprising joining elements for joining one deployed framework to another deployed framework.

12. The framework of claim 1 further comprising a through opening in the upper hub with an opening area of a significant portion of the overall footprint of the upper hub.

13. The framework of claim 1 further comprising a closed cinch passing around each of the masts of the framework, such that the cinch, in the deployed framework, limits the masts from pivoting relative to the tracks to which they are pivotally joined, by more than ninety degrees.

14. The framework of claim 1 further comprising a mechanical mechanism for unfolding the framework for deployment.

15. The framework of claim 14 wherein the mechanical mechanism comprises a line and pulley system.

16. The framework of claim 1 wherein pivotal attachment between tracks and masts comprises a pivotal and translatable unit connecting the tracks and masts, such that pivoting is accomplished and masts are also translatable through the unit, such that masts may be extended in a deployed framework to below the level of the co-planar tracks, simultaneously lowering the assembly of rafters and upper hub.

17. The framework of claim 1 wherein pivotal attachment between masts and rafters comprises a pivotal and translatable unit connecting the masts and rafters, such that pivoting is accomplished and rafters are also translatable through the unit, such that a roof defined by the rafters and the upper hub may be altered in pitch, flattened, and inverted.

18. The framework of claim 1 wherein pivotal attachment between masts and rafters comprises a pivotal and translatable unit connecting the masts and rafters, such that pivoting is accomplished and masts are also translatable through the unit, such that a roof defined by the rafters and the upper hub may be lowered relative to the lower hub without lowering the masts below the level of the lower hub.

19. The framework of claim 1 wherein all pivotal attachments between masts and tracks and masts and rafters comprise translation capability as well as pivotal capability, such that each pivotal and translatable unit provides fro relative translation between elements engaging the unit as well as pivoting.

20. The framework of claim 16 further comprising one or more additional lower hubs each having a set of tracks joined to the masts by pivotal and translatable units, the additional hub and track sets defining additional floors, such that multiple stories are provided by a single unit.

* * * * *